US010548793B2

(12) United States Patent
McKenney et al.

(10) Patent No.: US 10,548,793 B2
(45) Date of Patent: Feb. 4, 2020

(54) PINLESS LOADING FOR SPINE TABLE

(71) Applicant: Allen Medical Systems, Inc., Batesville, IN (US)

(72) Inventors: Kyle S. McKenney, Maynard, MA (US); Andrew D. Clark, Waltham, MA (US); Anthony V. Catacchio, Arlington, MA (US); Andrew Sennett, Hanover, MA (US); Jesse S. Drake, Westborough, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 205 days.

(21) Appl. No.: 15/597,401

(22) Filed: May 17, 2017

(65) Prior Publication Data

US 2017/0354563 A1 Dec. 14, 2017

Related U.S. Application Data

(60) Provisional application No. 62/357,429, filed on Jul. 1, 2016, provisional application No. 62/349,789, filed on Jun. 14, 2016.

(51) Int. Cl.

| | |
|---|---|
| ***A61G 13/00*** | (2006.01) |
| ***A61G 13/04*** | (2006.01) |
| ***A61G 13/06*** | (2006.01) |
| ***A61G 13/12*** | (2006.01) |
| ***A61G 7/00*** | (2006.01) |

(Continued)

(52) U.S. Cl.

CPC ..... *A61G 13/0054* (2016.11); *A61G 7/001* (2013.01); *A61G 7/008* (2013.01); *A61G 13/04* (2013.01); *A61G 13/06* (2013.01); *A61G 13/1295* (2013.01); *A61G 13/104* (2013.01)

(58) Field of Classification Search

CPC .... A61G 13/00; A61G 13/02; A61G 13/0054; A61G 13/10; A61G 13/1285; A61G 13/06; A61G 13/1295; A61G 13/04; A61G 13/104; A61G 2200/32; A61G 2200/325; A61G 2200/327; A61G 7/001; A61G 7/008; A61G 7/1019; A61B 6/0407

See application file for complete search history.

(56) References Cited

U.S. PATENT DOCUMENTS

| | | | |
|---|---|---|---|
| 1,098,477 | A | 6/1914 | Cashman |
| 1,160,451 | A | 11/1915 | Sanford |

(Continued)

FOREIGN PATENT DOCUMENTS

| | | |
|---|---|---|
| EP | 2653145 A2 | 10/2013 |
| JP | S55-184240 | 12/1980 |

(Continued)

OTHER PUBLICATIONS

Notification of Reasons for Rejection for Japanese Patent Application No. JP 2017-103716 dated Sep. 20, 2018; 8 pages total.

(Continued)

*Primary Examiner* — David R Hare

(74) *Attorney, Agent, or Firm* — Barnes & Thornburg LLP

(57) ABSTRACT

According to the present disclosure, a patient support device includes a patient support top, a support bracket, and a catch assembly that is slidably attached to the support bracket and that is operable to receive a connector of the patient support top.

18 Claims, 23 Drawing Sheets

(51) Int. Cl.
*A61G 7/008* (2006.01)
*A61G 13/10* (2006.01)

(56) References Cited

U.S. PATENT DOCUMENTS 1,171,713 A 2/1916 Gilkerson
1,528,835 A 3/1925 McCollough
1,662,464 A 3/1928 McCutchen
1,799,692 A 4/1931 Knott
1,938,006 A 12/1933 Blanchard
2,103,693 A 12/1937 Pohl
2,188,592 A 1/1940 Cunningham
2,261,297 A 11/1941 Seib
2,452,816 A 11/1948 Wagner
2,636,793 A 4/1953 Meyer
2,688,410 A 9/1954 Nelson
2,691,979 A 10/1954 Watson
2,764,150 A 9/1956 Ettinger et al.
2,792,945 A 5/1957 Brenny
3,046,071 A 7/1962 Shampaine et al.
3,049,726 A 8/1962 Getz
3,090,381 A 5/1963 Watson
3,226,734 A 1/1966 Coventon
3,281,141 A 10/1966 Smiley et al.
3,302,218 A 2/1967 Stryker
3,428,307 A 2/1969 Hunter et al.
3,584,321 A 6/1971 Buchanan
3,599,964 A 8/1971 Magni
3,640,416 A 2/1972 Temple
3,652,851 A 3/1972 Zaalberg
3,739,406 A 6/1973 Koetter
3,745,996 A 7/1973 Rush, Sr.
3,751,028 A 8/1973 Scheininger et al.
3,766,384 A 10/1973 Anderson
3,795,018 A 3/1974 Broaded
3,814,414 A 6/1974 Chapa
3,827,089 A 8/1974 Grow
3,873,081 A 3/1975 Smith
3,946,452 A 3/1976 Eary, Sr.
3,949,983 A 4/1976 Tommasino
3,988,790 A 11/1976 Mracek et al.
4,101,120 A 7/1978 Seshima
4,131,802 A 12/1978 Braden et al.
4,144,880 A 3/1979 Daniels
4,148,472 A 4/1979 Rais et al.
4,175,550 A 11/1979 Leininger et al.
4,186,917 A 2/1980 Rais et al.
4,227,269 A 10/1980 Johnston
4,244,358 A 1/1981 Pyers
4,384,378 A 5/1983 Getz et al.
4,398,707 A 8/1983 Cloward
4,407,274 A 10/1983 Goodley
4,466,427 A 8/1984 Granberg
4,503,844 A 3/1985 Siczek
4,539,979 A 9/1985 Bremer
4,545,571 A 10/1985 Chambron
4,546,766 A 10/1985 Hill et al.
4,552,346 A 11/1985 Schnelle et al.
4,579,111 A 4/1986 Ledesma
4,580,554 A 4/1986 Goodley
4,582,050 A 4/1986 Willis
4,606,333 A 8/1986 Graham
4,664,101 A 5/1987 Granberg
4,712,781 A 12/1987 Watanabe
4,730,606 A 3/1988 Leininger
4,763,643 A 8/1988 Vrzalik
4,771,785 A 9/1988 Duer
4,827,541 A 5/1989 Vollman et al.
4,840,362 A 6/1989 Bremer et al.
4,850,775 A 7/1989 Lee et al.
4,866,796 A 9/1989 Robinson et al.
4,872,657 A 10/1989 Lussi
4,887,325 A 12/1989 Tesch
4,937,901 A 7/1990 Brennan
4,939,801 A 7/1990 Schaal et al.
4,944,500 A 7/1990 Mueller et al.
4,953,245 A 9/1990 Jung
4,954,815 A 9/1990 Delmonte
4,970,737 A 11/1990 Sagel
4,971,043 A 11/1990 Jones
5,042,462 A 8/1991 Bremer
5,052,378 A 10/1991 Chitwood
5,088,706 A 2/1992 Jackson
5,131,106 A 7/1992 Jackson
5,161,267 A 11/1992 Smith
5,181,289 A 1/1993 Kassai
5,181,904 A 1/1993 Cook et al.
5,210,887 A 5/1993 Kershaw
5,210,888 A 5/1993 Canfield
5,231,741 A 8/1993 Maguire
5,239,716 A 8/1993 Fisk
5,274,862 A 1/1994 Palmer, Jr. et al.
5,299,334 A 4/1994 Gonzalez
5,308,359 A 5/1994 Lossing
5,333,334 A 8/1994 Kassai
5,393,018 A 2/1995 Roth et al.
5,444,882 A 8/1995 Andrews et al.
5,451,202 A 9/1995 Miller et al.
5,461,740 A * 10/1995 Pearson ..... A61G 7/012 5/607
5,483,323 A 1/1996 Matsuda et al.
5,487,195 A 1/1996 Ray
5,499,408 A 3/1996 Nix
5,524,304 A 6/1996 Shutes
5,544,371 A 8/1996 Fuller
5,579,550 A 12/1996 Bathrick et al.
5,588,705 A 12/1996 Chang
5,594,963 A 1/1997 Berkowitz
5,611,638 A * 3/1997 Dorr ..... A61G 7/1019 403/321
5,613,254 A 3/1997 Clayman et al.
5,658,315 A * 8/1997 Lamb ..... A61F 5/04 602/32
5,667,529 A 9/1997 Butner
5,673,443 A 10/1997 Marmor
5,722,420 A 3/1998 Lee
5,722,941 A 3/1998 Hart
5,737,781 A 4/1998 Votel
5,775,334 A 7/1998 Lamb et al.
5,794,286 A 8/1998 Scott et al.
5,865,780 A 2/1999 Tuite
5,890,238 A 4/1999 Votel
5,895,367 A 4/1999 Mautoni
5,901,388 A 5/1999 Cowan
5,937,456 A 8/1999 Norris
6,003,174 A 12/1999 Kantrowitz et al.
6,035,465 A 3/2000 Rogozinski
6,042,558 A 3/2000 Hoyne et al.
6,049,923 A 4/2000 Ochiai
6,076,525 A 6/2000 Hoffman
6,112,349 A 9/2000 Connolly
6,123,680 A 9/2000 Brummer
6,154,901 A 12/2000 Carr
6,258,050 B1 7/2001 Henderson
6,260,220 B1 * 7/2001 Lamb ..... A61G 13/02 5/601
6,282,736 B1 9/2001 Hand et al.
6,286,164 B1 9/2001 Lamb et al.
6,295,671 B1 10/2001 Reesby et al.
6,311,349 B1 11/2001 Kazakia et al.
6,315,564 B1 11/2001 Levisman
6,324,710 B1 12/2001 Hernandez et al.
6,421,854 B1 7/2002 Heimbrock
6,438,777 B1 8/2002 Bender
6,496,991 B1 12/2002 Votel
6,499,158 B1 12/2002 Easterling
6,499,160 B2 12/2002 Hand et al.
6,505,365 B1 * 1/2003 Hanson ..... A61G 7/005 5/510
6,506,174 B1 1/2003 Saunders et al.
6,511,450 B1 1/2003 Bauermeister
6,523,197 B2 2/2003 Zitzmann
6,526,610 B1 3/2003 Hand et al.
6,584,630 B1 7/2003 Dinkler

(56) References Cited

U.S. PATENT DOCUMENTS 6,599,257 B2 7/2003 Al-Obaidi et al.
6,609,260 B2 8/2003 Hand et al.
6,615,430 B2 9/2003 Heimbrock
6,622,324 B2 9/2003 VanSteenburg et al.
6,634,043 B2 10/2003 Lamb et al.
6,637,058 B1 10/2003 Lamb
6,638,299 B2 10/2003 Cox
6,662,388 B2 12/2003 Friel et al.
6,668,396 B2 12/2003 Wei
6,671,904 B2 1/2004 Easterling
6,681,423 B2 1/2004 Zachrisson
6,691,347 B2 2/2004 Hand et al.
6,701,553 B1 3/2004 Hand et al.
6,701,554 B2 3/2004 Heimbrock
6,721,976 B2 4/2004 Schwaegerle
6,813,788 B2 11/2004 Dinkler et al.
6,817,363 B2 11/2004 Biondo et al.
6,854,137 B2 2/2005 Johnson
6,857,144 B1 2/2005 Huang
6,859,967 B2 3/2005 Harrison et al.
6,862,759 B2 3/2005 Hand et al.
6,862,761 B2 3/2005 Hand et al.
6,874,181 B1 4/2005 Connolly et al.
6,886,199 B1 5/2005 Schwaegerle
6,898,811 B2 5/2005 Zucker et al.
6,899,690 B2 5/2005 Saunders et al.
6,912,959 B2 7/2005 Kolody et al.
6,928,676 B1 8/2005 Schwaegerle
6,941,951 B2 9/2005 Hubert et al.
6,966,081 B1 11/2005 Sharps et al.
6,971,997 B1 12/2005 Ryan et al.
6,984,217 B2 1/2006 Becerra et al.
6,986,179 B2 1/2006 Varadharajulu et al.
7,020,917 B1 4/2006 Kolody et al.
7,060,013 B2 6/2006 Steinbach et al.
7,089,612 B2 8/2006 Rocher et al.
7,089,884 B2 8/2006 Wang et al.
7,103,932 B1 9/2006 Kandora
7,108,671 B2 9/2006 Saunders et al.
7,137,160 B2 * 11/2006 Hand ..... A61G 7/008 5/607
7,144,380 B2 12/2006 Gilliam
7,152,261 B2 12/2006 Jackson
7,171,709 B2 2/2007 Weismiller
7,197,778 B2 4/2007 Sharps
7,214,138 B1 5/2007 Stivers et al.
7,216,385 B2 5/2007 Hill
7,234,180 B2 6/2007 Horton et al.
7,255,666 B2 8/2007 Cardenas
7,290,302 B2 11/2007 Sharps
7,341,565 B2 3/2008 Splane, Jr. et al.
7,343,635 B2 3/2008 Jackson
7,343,916 B2 3/2008 Biondo et al.
7,357,777 B1 4/2008 Meyers
7,496,980 B2 3/2009 Sharps
7,520,007 B2 4/2009 Skripps
7,520,008 B2 4/2009 Wong et al.
7,565,708 B2 * 7/2009 Jackson ..... A61G 7/001 5/611
7,566,314 B2 7/2009 Saunders et al.
7,600,281 B2 10/2009 Skripps
7,653,950 B2 2/2010 Johnson
7,654,974 B2 2/2010 Bass
7,669,262 B2 3/2010 Skripps et al.
7,694,369 B2 4/2010 Hinders et al.
7,739,762 B2 6/2010 Lamb et al.
7,810,185 B2 10/2010 Burstner et al.
7,824,353 B2 11/2010 Matta
7,861,720 B1 1/2011 Wolcott
7,882,583 B2 2/2011 Skripps
7,931,607 B2 4/2011 Biondo et al.
7,954,996 B2 * 6/2011 Boomgaarden ..... A61B 6/00 378/167
D645,967 S 9/2011 Sharps
8,020,227 B2 9/2011 Dimmer et al.
8,042,208 B2 10/2011 Gilbert et al.
8,056,163 B2 11/2011 Lemire et al.
8,060,960 B2 11/2011 Jackson
8,083,705 B2 12/2011 Saunders et al.
D663,427 S 7/2012 Sharps
D665,912 S 8/2012 Skripps
8,234,730 B2 8/2012 Skripps
8,234,731 B2 8/2012 Skripps
8,256,050 B2 9/2012 Wong et al.
8,273,046 B2 9/2012 Walther et al.
8,286,283 B2 10/2012 Copeland et al.
8,308,616 B1 11/2012 Flavell
D676,971 S 2/2013 Sharps
8,381,331 B2 2/2013 Sharps et al.
8,397,323 B2 3/2013 Skripps et al.
D683,032 S 5/2013 Sharps
8,464,375 B1 6/2013 Jorgensen
8,486,068 B2 7/2013 Starr
8,496,605 B1 7/2013 Chavers
8,555,439 B2 10/2013 Soto et al.
8,584,281 B2 11/2013 Diel et al.
8,590,074 B2 11/2013 Hornbach et al.
8,635,725 B2 1/2014 Tannoury et al.
8,676,293 B2 3/2014 Breen et al.
8,677,529 B2 3/2014 Jackson
8,707,476 B2 4/2014 Sharps
8,707,484 B2 4/2014 Jackson et al.
8,719,979 B2 5/2014 Jackson
8,732,876 B2 5/2014 Lachenbruch et al.
8,763,178 B1 7/2014 Martin et al.
8,777,878 B2 7/2014 Deitz
8,782,832 B2 7/2014 Blyakher et al.
8,806,679 B2 8/2014 Soto et al.
8,826,474 B2 9/2014 Jackson
8,826,475 B2 9/2014 Jackson
8,833,707 B2 9/2014 Steinberg et al.
8,839,471 B2 9/2014 Jackson
8,844,077 B2 9/2014 Jackson et al.
8,845,264 B2 9/2014 Kubiak et al.
8,856,986 B2 10/2014 Jackson
8,858,470 B2 10/2014 Henderson et al.
8,864,205 B2 10/2014 Lemire et al.
8,893,333 B2 11/2014 Soto et al.
D720,076 S 12/2014 Sharps et al.
8,905,958 B2 12/2014 Senyei et al.
8,938,826 B2 1/2015 Jackson
8,978,180 B2 3/2015 Jackson
8,997,286 B2 4/2015 Wyslucha et al.
9,119,610 B2 9/2015 Matta et al.
9,180,062 B2 11/2015 Jackson
9,205,013 B2 12/2015 Jackson
9,211,223 B2 12/2015 Jackson
9,233,037 B2 1/2016 Sharps et al.
9,289,342 B2 3/2016 Jackson
9,295,433 B2 3/2016 Jackson et al.
9,308,145 B2 4/2016 Jackson
9,339,430 B2 5/2016 Jackson et al.
9,364,380 B2 6/2016 Jackson
9,561,145 B2 * 2/2017 Jackson ..... A61G 13/0036
2003/0018287 A1 1/2003 Gilliam
2003/0088200 A1 5/2003 Saunders et al.
2003/0114780 A1 6/2003 Al-Obaidi et al.
2003/0126683 A1 7/2003 Hand et al.
2003/0135137 A1 7/2003 Splane, Jr.
2004/0133983 A1 7/2004 Newkirk et al.
2004/0143206 A1 7/2004 Saunders et al.
2005/0010152 A1 1/2005 Becerra et al.
2005/0222523 A1 10/2005 Splane, Jr. et al.
2006/0052222 A1 3/2006 Cardenas
2006/0058720 A1 3/2006 Becerra et al.
2006/0185090 A1 8/2006 Jackson
2006/0206046 A1 9/2006 Saunders et al.
2006/0224097 A1 10/2006 Bass
2007/0027422 A1 2/2007 Becerra et al.
2007/0106192 A1 5/2007 Johnson
2007/0208289 A1 9/2007 Walther et al.
2009/0118657 A1 5/2009 Saunders et al.
2009/0198163 A1 8/2009 Senyei et al.
2010/0094190 A1 4/2010 Walther et al.

(56) References Cited

U.S. PATENT DOCUMENTS

| | | | | |
|---|---|---|---|---|
| 2011/0083273 | A1 | 4/2011 | Sharps | |
| 2011/0107516 | A1 | 5/2011 | Jackson et al. | |
| 2011/0247903 | A1 | 10/2011 | Boukhny et al. | |
| 2012/0255122 | A1 | 10/2012 | Diel et al. | |
| 2013/0111666 | A1 | 5/2013 | Jackson | |
| 2013/0219623 | A1 | 8/2013 | Jackson | |
| 2013/0254996 | A1 | 10/2013 | Jackson | |
| 2013/0269710 | A1* | 10/2013 | Hight | A61G 13/04 128/845 |
| 2013/0289464 | A1 | 10/2013 | Guenniche et al. | |
| 2013/0312187 | A1 | 11/2013 | Jackson | |
| 2013/0312188 | A1* | 11/2013 | Jackson | A61G 7/015 5/618 |
| 2014/0007349 | A1 | 1/2014 | Jackson | |
| 2014/0020181 | A1 | 1/2014 | Jackson | |
| 2014/0033436 | A1 | 2/2014 | Jackson | |
| 2014/0068861 | A1* | 3/2014 | Jackson | A61G 13/04 5/601 |
| 2014/0173826 | A1 | 6/2014 | Jackson | |
| 2014/0196212 | A1 | 7/2014 | Jackson | |
| 2014/0201913 | A1 | 7/2014 | Jackson | |
| 2014/0201914 | A1 | 7/2014 | Jackson | |
| 2014/0208512 | A1 | 7/2014 | Jackson | |
| 2014/0317847 | A1 | 10/2014 | Jackson | |
| 2015/0059094 | A1* | 3/2015 | Jackson | A61B 6/0407 5/608 |
| 2015/0113733 | A1 | 4/2015 | Diel et al. | |
| 2015/0150743 | A1 | 6/2015 | Jackson | |
| 2015/0157487 | A1 | 6/2015 | Senyei et al. | |
| 2016/0000621 | A1 | 1/2016 | Jackson et al. | |
| 2016/0000626 | A1 | 1/2016 | Jackson et al. | |
| 2016/0000627 | A1 | 1/2016 | Jackson et al. | |
| 2016/0000629 | A1 | 1/2016 | Jackson et al. | |
| 2016/0008195 | A1 | 1/2016 | Lokken et al. | |
| 2017/0112698 | A1 | 4/2017 | Hight et al. | |
| 2017/0112699 | A1 | 4/2017 | Hight et al. | |

FOREIGN PATENT DOCUMENTS

| | | | |
|---|---|---|---|
| JP | 2002519111 | A | 7/2002 |
| JP | 2013223722 | A | 10/2013 |
| WO | 2011006163 | A2 | 1/2011 |

OTHER PUBLICATIONS

EP Search Report for EP 17175422.9 dated Nov. 9, 2017; 9 pages.
Trios® Table Base Owner's Manual; Chapter 6; pp. 43-52 (10 pp.); 2015.

* cited by examiner

PINLESS LOADING FOR SPINE TABLE

CROSS-REFERENCE TO RELATED APPLICATIONS

The present application claims the benefit, under 35 U.S.C. § 119(e), of U.S. Provisional Application No. 62/349,789, filed Jun. 14, 2016, and of U.S. Provisional Application No. 62/357,429, filed Jul. 1, 2016, the contents of each of which are hereby incorporated by reference, in their entireties, and including at least those portions directed to patient support systems, methods, and devices.

BACKGROUND

The present disclosure relates to devices, systems, and methods for patient support. More specifically, the present disclosure relates to devices, systems, and methods for surgical patient support.

Patient supports, such as surgical support tables, provide support to various portions of a patient's body. Versatile positioning of table tops of the patient supports provides access to various parts of a patient's body. Moreover, various types of table tops can accommodate the surgical needs of different patients, different techniques and/or procedures, and/or preferences of the surgical team. Spinal surgery tables may have a base unit and a variety of different types of table tops that attach to the base unit depending upon the surgical procedure to be performed.

SUMMARY

The present application discloses one or more of the features recited in the appended claims and/or the following features which, alone or in any combination, may comprise patentable subject matter:

According to an aspect of the disclosure, a top-loading patient support device may include a patient support top that may include a connector disposed at a longitudinal end thereof and an end support that may be configured to support the patient support top. A support bracket may be connected to the end support. A catch assembly may be attached to the support bracket for selectively receiving the connector of the patient support top. The catch assembly may include a main body extending between opposite ends and a pair of catch holds that may extend from the main body. Each of the catch holds may include a catch body and a catch arm that may extend from the catch body to define a receptacle that may have an open top for receiving the connector of the patient support top. The patch assembly may include a latch assembly that may have a latch that may be operable between a first position in which the latch is retracted from the open top of the receptacle and a second position in which the latch extends at least partly across the open top of the receptacle to block removal of the connector from the receptacle.

In some embodiments, the latch may be pivotably attached to an interior side of one of the catch holds. Each catch body may include a top surface and each respective, catch arm may include a side surface. The respective top and side surfaces of each catch hold together may define at least a portion of the receptacle. Each latch may include a top surface and a side surface that together may define a latch receptacle. When the latch is in the second position, the top surface of the latch may be aligned with the top surface of the catch body to form a continuous surface for engagement with the connector of the patient support top. In some embodiments, when the latch is in the second position, the side surface of the latch may be aligned with the side surface of the catch body to form a continuous side surface.

In some embodiments, the latch may include an end section that may protrude at least partly across the open top when the latch is in the second position. Optionally, the end section may be arranged out of alignment with the open top when the latch is in the first position. In some embodiments, the latch assembly may include a spring that may be configured to bias the latch into the second position. In some embodiments, the catch assembly may include a pawl assembly that may include a pawl to selectively fix the position of the catch assembly relative to the support bracket. The pawl may be operable between a locked position and an unlocked position, for example.

In some embodiments, the pawl may include a lever that may have a pivot end, a free end opposite the pivot end, and a pawl head that may extend from the free end for engagement with teeth of the support bracket. In some embodiments, the support bracket may include a pawl track that may have a number of teeth consecutively arranged for engagement with the pawl head. Each tooth may include a flat surface and a curved surface that may be opposite the flat surface. The flat surface of one tooth of the number of teeth, together with the curved surface of an adjacent tooth of the number of teeth, may cooperate to define a pawl space for receiving the pawl head therein.

In some embodiments, the pawl head may be selectively received within the pawl space. The pawl head may be blocked against removal from the pawl space while in contact with either of the curved surface or the flat surface of the corresponding tooth. In some embodiments, the pawl head may be triangular.

According to another aspect of the disclosure, a top-loading patient support device may include a patient support top including a connector that may be disposed at a longitudinal end thereof, a pair of end supports that may be configured to support the patient support top, and a catch assembly that may be attached to one of the end supports and that may include a catch device and a latch assembly. The catch device may include a catch housing and a support arm that may extend from the catch housing. The support arm may include a top surface that defines a receptacle having an open top for receiving the connector of the patient support top. The latch assembly may include a latch that may be coupled to the catch housing and that may be pivotable about a pivot axis between a first position that is retracted from the open top of the receptacle and a second position in which the latch extends at least partly across the open top of the receptacle to block removal of the connector from the receptacle.

In some embodiments, the catch housing may include a main body and a cover that may be configured for attachment to the main body. The main body may define an interior and the latch may be received within the interior. The latch may include a latch body having a stem that may be pivotably connected at one end to the catch housing. A tab may extend from the stem in a pivot plane of the latch. In some embodiments, in the first position the tab may be arranged within the interior of the main body and in the second position the tab may protrude from the main body at least partly across the open top of the receptacle to block removal of the connector from the receptacle.

In some embodiments, the stem may be configured to receive force by a user to pivot the latch between the first and second positions. Optionally, the latch assembly may include a resilient member that may be arranged to bias the latch into the second position. In some embodiments, the tab may include a slanted upper surface that may be adapted for contact with the connector of the patient support top to pivot the latch from the second position towards the first position to permit passage of the connector through the open top of the receptacle. Alternatively or additionally, the tab may include a lower surface that may be adapted for contact with the connector of the patient support top and that may face radially outward from the pivot axis such that contact with the connector may not pivot the latch from the second position towards the first position to block removal of the connector from the receptacle.

In some embodiments, the top surface of the support arm may have a U-shape. In some embodiments, the open top of the receptacle may be sized to allow the connector of the patient support top to pass therethrough into the receptacle.

According to another aspect of the present disclosure, a patient support device may include a patient support top having a connector disposed at an end thereof, an end support configured to support the patient support top, and a support attachment connected with the end support. The support attachment may include a catch assembly configured for selective connection with the connector of the patient support top. The catch assembly may include a receptacle for receiving the connector. The patch assembly may include a latch assembly for selectively blocking removal of the connector from the receptacle. The receptacle may include an entry opening for acceptance of the connector of the patient support top into the receptacle.

In some embodiments, the latch assembly may include a latch operable between a first position in which the latch is clear from the entry opening to allow acceptance of the connector within the receptacle and a second position in which the latch extends at least partly across the entry opening to block removal of the connector from the receptacle. In some embodiments, the support attachment may include a bracket and the catch assembly may be connected with the bracket. The bracket may include a tilt assembly for selective pivoting of the catch assembly while secured with the end support to assist selective connection with the patient support top.

In some embodiments, the tilt assembly may include a release gate secured with the end support and attached to a rail of the bracket for selective pivoting of the catch assembly. The tilt assembly may include a tilt lock assembly operable between an unlatched state to allow pivoting of the rail relative to the release gate and a latched position to block pivoting of the rail relative to the release gate.

In some embodiments, the tilt lock assembly may include a lock shaft rotatably mounted in one of the rail and the release gate. The lock shaft may be operable between a locked position to engage both the rail and the release gate to block relative pivoting and an unlocked position to at least partly disengage with the other of the rail and the release gate to allow relative pivoting. In some embodiments, the tilt lock assembly may include a lock slot defined within the other of the rail and the release gate.

In some embodiments, the lock slot may include a lock home and a pivot route extending for a length from the lock home. In some embodiments, the length of the pivot route may have a curvature corresponding with pivoting of the rail relative to the release gate. In some embodiments, the lock shaft may extend into the lock slot. The lock shaft and the lock slot may be formed in correspondence with each other to permit relative traversal of the lock shaft within the pivot route only in the unlocked position. In some embodiments, the lock shaft may have a non-circular cross-section. In some embodiments, the lock shaft may have a bean shaped cross-section.

In some embodiments, the lock shaft may extend into the lock slot. The lock shaft and the lock slot may be formed in correspondence with each other to prevent relative entry of the lock shaft into the pivot route in the locked position. In some embodiments, the lock shaft and the lock slot may be formed in correspondence with each other to permit selective rotation of the lock shaft only when arranged within the lock home.

According to another aspect of the present disclosure, a support attachment of a patient support device for attachment between an end support and a connector of a patient support top of the patient support device may include a bracket adapted to connect with the end support, a catch assembly attached with the bracket, the catch assembly including a receptacle for receiving the connector of the patient support top and a tilt assembly including a release gate pivotably connected with the bracket. The tilt assembly may include a tilt lock assembly operable between an unlocked state to allow pivoting of the bracket relative to the release gate and a locked state to block pivoting of the bracket relative to the release gate. In some embodiments, the catch assembly may include a latch assembly for selectively blocking removal of the connector from the receptacle.

In some embodiments, the catch assembly may include a pawl assembly having a pawl adapted to selectively fix the position of the catch assembly relative to the bracket. The pawl may be operable between a locked position and an unlocked position.

In some embodiments, the pawl may include a lever having a pawl end and a pawl head that extends from the pawl end for engagement with the bracket. In some embodiments, the bracket may include a pawl track having a number of teeth consecutively arranged for engagement with the pawl head to selectively fix the position the catch assembly relative to the bracket. In some embodiments, each tooth may include a first surface and a second surface opposite the first surface. The first surface of one tooth of the number of teeth together with the second surface of an adjacent tooth of the number of teeth may cooperate to define a pawl space for receiving the pawl head therein to selectively fix the position of the catch assembly.

In some embodiments, the pawl head may be selectively received within the pawl space. The pawl head may blocked against removal from the pawl space by at least one of the first and second surfaces of the corresponding teeth without unloading of the catching assembly.

In some embodiments, the lever may be pivotable to place the pawl between the locked and unlocked positions. Pivoting movement of the lever of the pawl may correspond with the pawl space, as defined by the first and second surfaces, to require that the pawl head be located intermediately within the pawl space arranging the pivoting movement of the lever to be free of contact between the pawl head and either of the first and second surfaces to allow the pawl to be operated into the unlocked position. In some embodiments, the pawl head may be arranged intermediately within the pawl space by translation of the catch assembly along the bracket with the pawl in the locked position.

In some embodiments, the support attachment may include a tilt section for connecting the bracket with the end support. The tilt section may include a locking pin slidably disposed in the support bracket for engagement with the end support. The locking pin may be operable between a locked position projecting from the bracket for engagement with the end support and unlocked position retracted into the bracket.

In some embodiments, the tilt section may include a safety latch assembly having a safety pin and a pin slot receiving the safety pin. The safety pin may include a first section having a first diameter and may include a second section having a second diameter larger than the first diameter.

In some embodiments, the pin slot may include a latch receptacle sized complimentary to the second section of the safety pin and a slide receptacle sized complimentary to the first section of the safety pin. In some embodiments, the safety pin may be operable between a latched position in which the second section is received within the latch receptacle to prevent translation of the safety pin along the pin slot to block operation of the locking pin out of the locked position, and an unlatched position in which the second section is removed from the latch receptacle to permit translation of the safety pin along the pin slot to allow removal of the locking pin from the locked position.

In some embodiments, the release gate may be attached to a rail of the bracket for selective pivoting and may be adapted for securing with the end support. The release gate may include a tilt lock assembly having a lockout member positionable between a locked position and an unlocked position to achieve the locked and unlocked, states of the tilt lock assembly, respectively.

In some embodiments, the lockout member of the tilt lock assembly may include a lock shaft rotatably arranged in at least one of the rail and the release gate. The lock shaft may be operable between a locked position to engage both the rail and the release gate to block relative pivoting and an unlocked position to allow relative pivoting. In some embodiments, the tilt lock assembly may include a lock slot defined within the other of the release gate and the rail. The lock slot may include a look home and a pivot route extending for a length from the lock home. In some embodiments, the length of the pivot route may have a curvature corresponding with pivoting of the rail relative to the release gate.

In some embodiments, the lock shall may extend into the lock slot. The lock shaft and the lock slot may be formed in correspondence with each other to permit relative traversal of the lock shaft within the pivot route only in the unlocked position. In some embodiments, the lock shaft may have a non-circular cross-section. In some embodiments, the lock shaft may have a bean shaped cross-section.

In some embodiments, the lock shaft may extend into the lock slot. The lock shaft and the lock slot may be formed in correspondence with each other to prevent relative entry of the lock shaft into the pivot route in the locked position. The lock shaft and the lock slot may be formed in correspondence with each other to permit selective rotation of the lock shaft only when arranged within the lock home.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
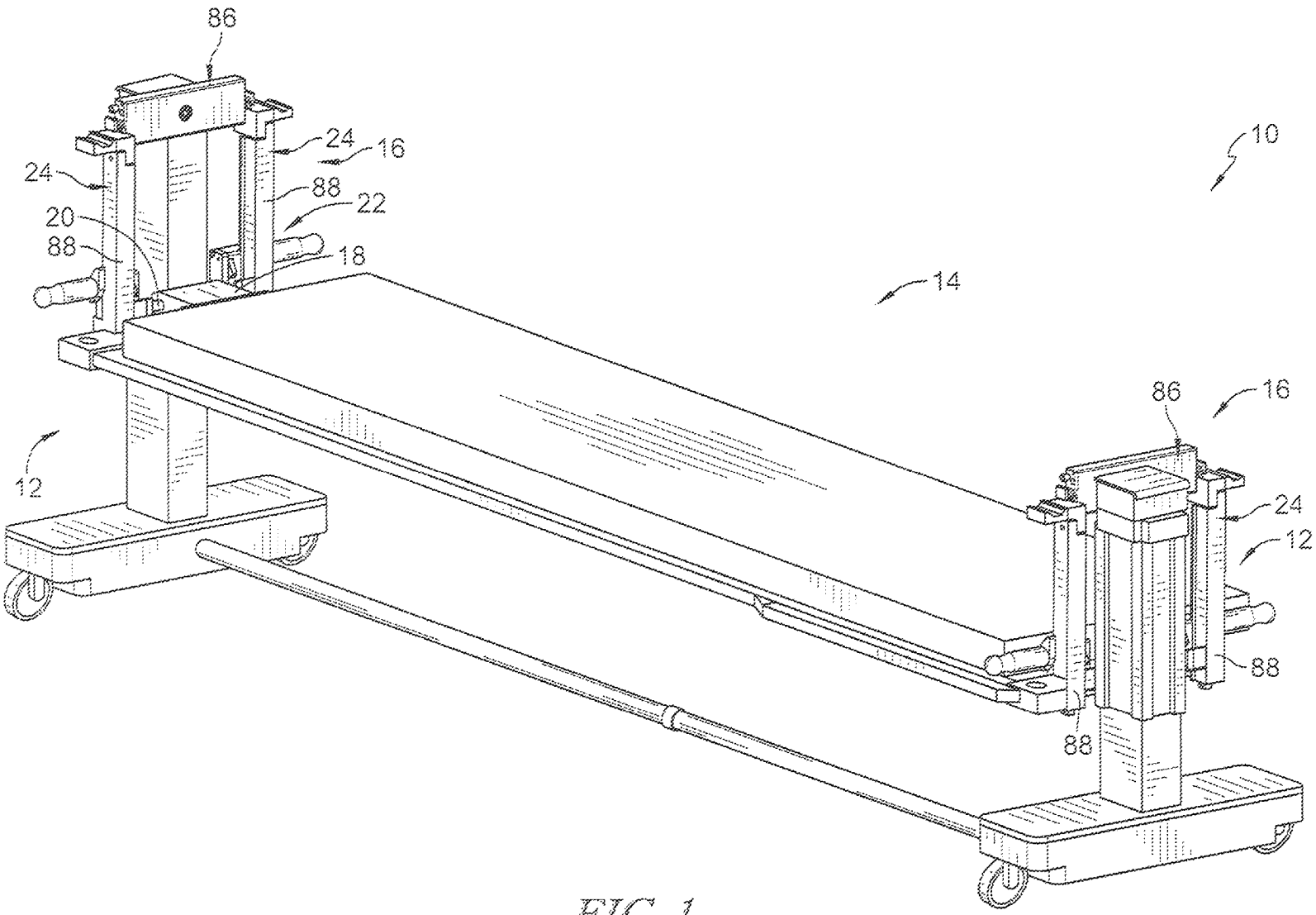
FIG. 1 is a perspective view of a patient support system including a tower base connected to a patient support top by support attachments including a support bracket and a catch assembly that is selectively positionable along the length of the support bracket and that defines a receptacle for receiving a connection tube of the patient support top.

For the purposes of promoting an understanding of the principles of the disclosure, reference will now be made to a number of illustrative embodiments illustrated in the drawings and specific language will be used to describe the same.

In performance of various surgical procedures, providing surgical access to surgery sites on a patient's body promotes favorable surgical conditions and increases the opportunity for successful results. Patient support devices can assist in positioning the patients body to provide a surgical team preferred and/or appropriate access to particular surgical sites. Patient supports devices can include patient support tops which are supported above the floor by support structures. Selective attachment of patient support tops to the support structures enables the use of a variety of support tops and promotes ease of mobility and storage of the patient support devices.

An illustrative embodiment of a patient support system 10 includes a pair of end supports, such as illustrative tower bases 12, a patient support top 14, and a pair of support attachments 16 each connected to the tower bases 12. The support attachments 16 are configured to selectively connect to the patient support top 14 to support the top 14 above the floor as shown in FIG. 1. At each longitudinal end, the patient support top 14 illustratively includes a coupler assembly 18 having a connection tube 20 for selective connection with a catch assembly 22 of each support attachment 16.

Figure 2:
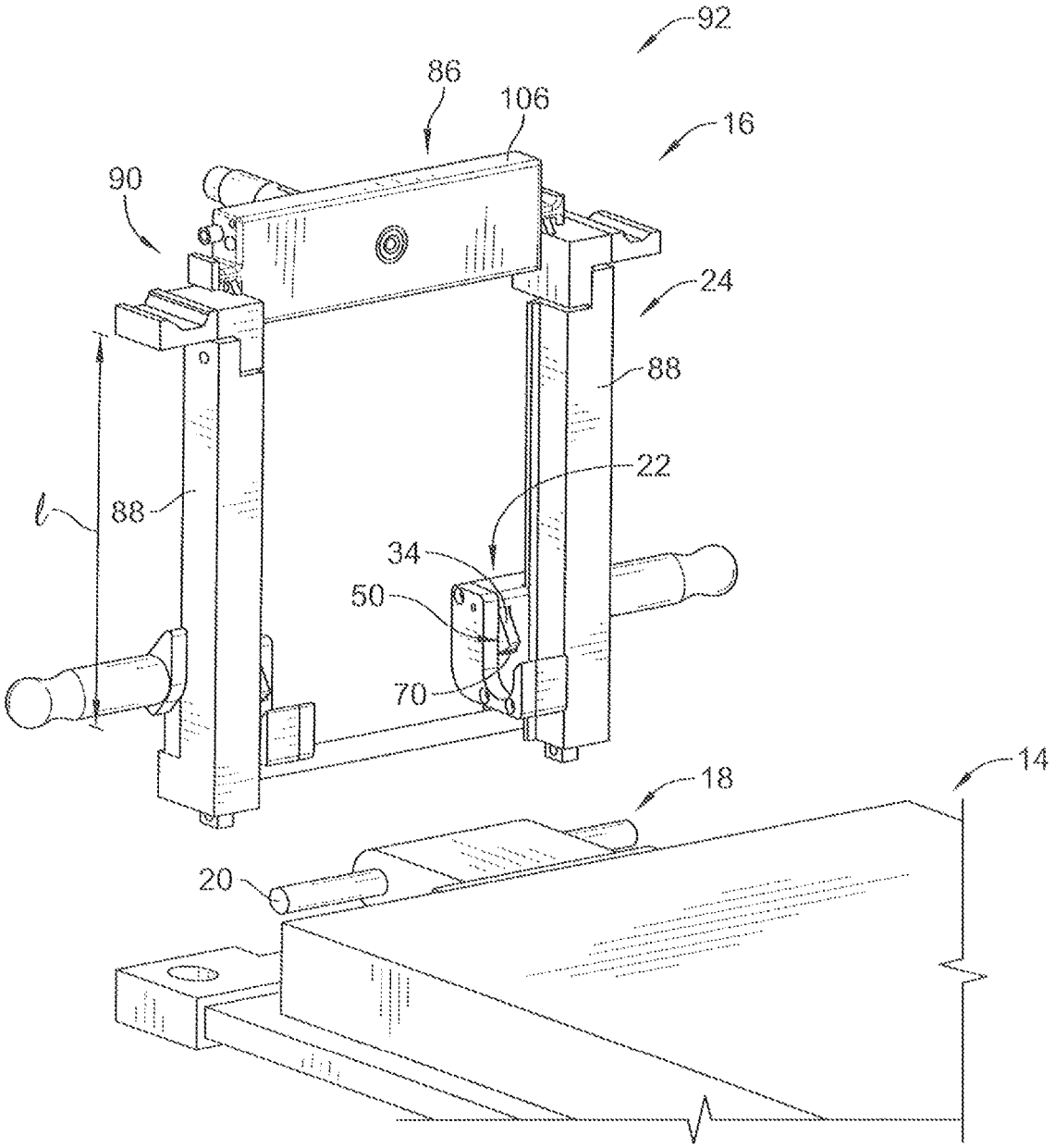
FIG. 2 is a perspective view of a support attachment of the patient support system shown in FIG. 1 showing that the catch assembly is a top-loading assembly and includes a pair of catch holds that define the receptacle for receiving the connection tube of the patient support top.

As best shown in the illustrative embodiment of FIG. 2, each support attachment 16 illustratively includes the catch assembly 22 and a support bracket 24 connected with the tower base 12 and extending from the tower base 12 along a length l. The catch assembly 22 illustratively couples to the support bracket 24 for selective positioning along the length l of the support bracket 24. The catch assembly 22 locks in place at discrete, spaced locations, along the length l of support bracket 24. The catch assembly 22 receives the connection tube 20 for selective connection of the patient support top 14 with the tower base 12 as shown in FIGS. 1-4.

An example of an acceptable coupler assembly 18 is disclosed in U.S. Patent Application Publication No. 2013/0269710 to Night et al., the contents of which are hereby incorporated by reference in their entirety, and at least including the descriptions and figures related to the motion coupler "218" and related features disclosed therein. In some embodiments, the patient support top 14 may be connected to the support attachment 16 in any suitable manner.

Figure 3:
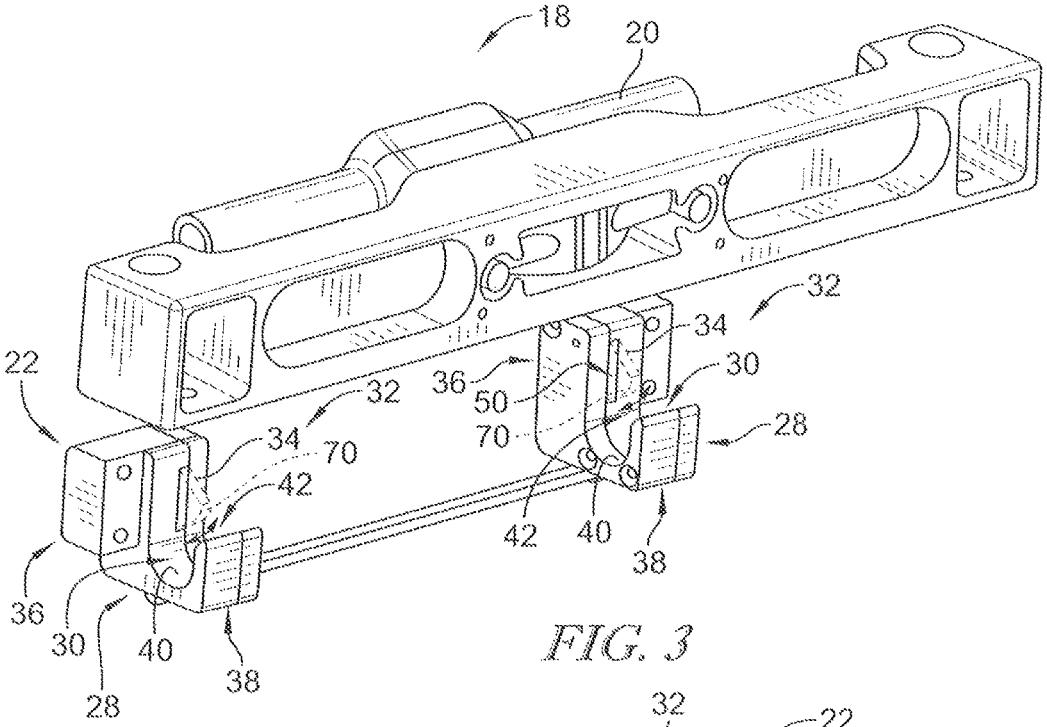
FIG. 3 is a perspective view of the catch assembly of the patient support system shown in FIGS. 1 and 2 showing the catch holds each including a latch that is movable between latched and unlatched positions.
Figure 4:
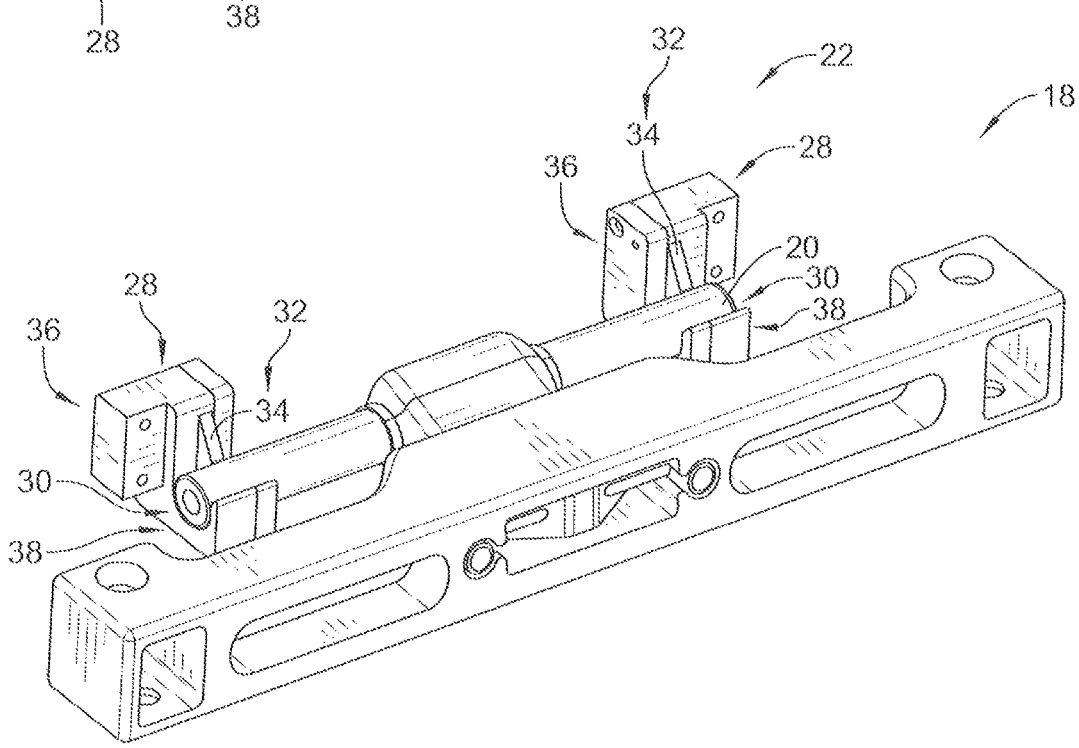
FIG. 4 is a perspective view of the catch assembly shown in FIG. 3 showing the connector of the patient support top received within the receptacle of the catch holds and the latches in the latched position extending partly across the open top of the receptacle to block removal of the connector from the receptacle.

As best shown in FIGS. 3 and 4, the catch assembly 22 is illustratively embodied as a top-loading catch assembly operable to selectively secure the patient support top 14 with the tower bases 12. The catch assembly 22 illustratively includes a pair of catch holds 28 each defining a catch receptacle 30 for receiving the connection tube 20. Each of the pair of catch holds 28 include a latch assembly 32 having a retractable latch 34. The latch 34 is pivotably connected to the respective catch hold 28 and is manually operable between an unlatched position (retracted position, shown in solid line in FIG. 3) and a latched position (extended position, shown in broken line in FIG. 3 and in solid line in FIG. 4) for blocking removal of the connection tube 20 from the catch receptacle 30.

Each catch hold 28 includes a catch body 36 and a catch arm 38 that extends from the catch body 36 to form the catch receptacle 30. Each catch arm 38 includes a top surface 40 that defines the catch receptacle 30 and engages with the connection tube 20. The top surface 40 of the catch arm 38 is illustratively formed to have a U-shape that is complimentary to the shape of the connection tube 20 and such that the catch receptacle 30 has an open top 42 for insertion of the connection tube 20. In some embodiments, the catch arm 38 and the connection tube 20 may have any suitable shapes complimentary to each other for selective connection.

Figure 5:
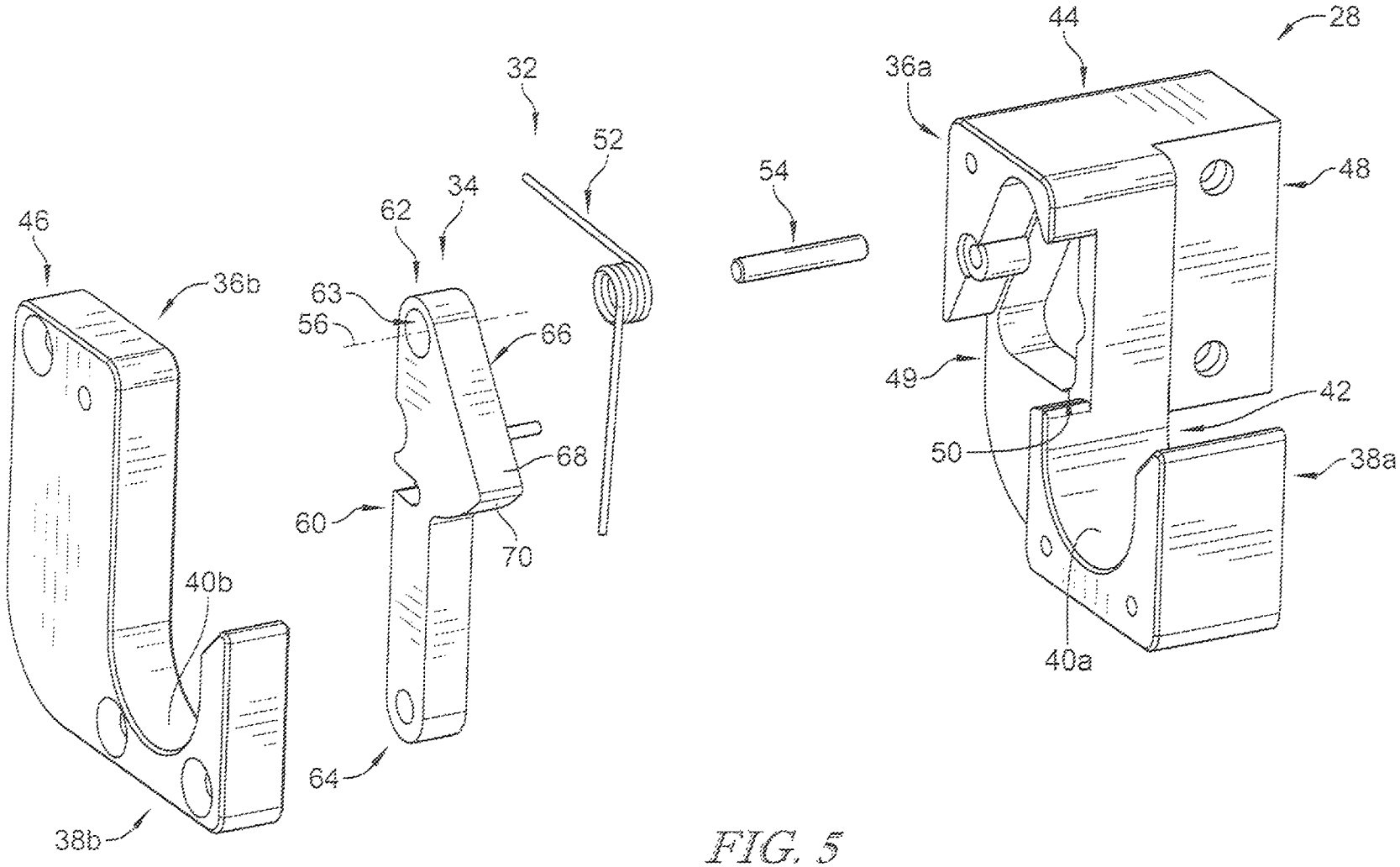
FIG. 5 is an exploded perspective view of one of the catch assemblies of FIGS. 1-4.

As shown best in FIG. 5, each catch hold 28 illustratively comprises a carriage 44 and a cover 46 that together form each of the catch body 36 and the catch arm 38. In the illustrative embodiment, each carriage 44 includes a catch body portion 36*a* and a catch arm portion 38*a* extending from a side of the catch body portion 36*a* and defining a top surface 40*a*, and each cover 46 includes a catch body portion 36*b* and a catch arm portion 38*b* extending from a side of the catch body portion 36*a* and defining a top surface 40*b*. The catch body 36 illustratively comprises the catch body portions 36*a*, 36*b*, the catch arm 38 illustratively comprises the catch arm portions 38*a*, 38*b*, and the top surface 40 illustratively comprises the top surface portions 40*a*, 40*b*.

In the illustrative embodiment as shown in FIG. 5, the carriage 44 illustratively includes a flange 48 extending in a direction perpendicular to the catch arm portion 38*a* for connection with the support bracket 24. The cover 46 is illustratively attached to the carriage 42 opposite the flange 48 to enclose the latch assembly 32 within an interior cavity 49 defined in the carriage 42. The carriage 44 illustratively includes a latch opening 50 defined therein on the side of the catch body portion 36*a* of the carriage 44 from which the catch arm portion 38*a* extends and connected to the interior cavity 49. When the latch 34 of the latch assembly 32 is pivoted into the latched position, the latch 34 extends through the latch opening 50 to engage the connection tube 20.

The latch assembly 32 illustratively includes the latch 34, a resilient member embodied as a torsion spring 52 disposed to bias the latch 34 into the latched position, and a pivot pin 54 for pivotably attaching the latch 34 to the catch body 36. The pivot pin 54 extends through a pin hole 63 of the latch 34 along a pivot axis 56 thereof and is supported on opposite ends by each of the carriage 44 and the cover 46. The latch 34 is illustratively attached to the catch hold 28 by the pivot pin 54 for pivoting about the axis 56 between the latched and unlatched positions.

As shown in FIG. 5, the latch 34 illustratively includes a stem 60 extending between a pivot end 62 and a free end 64, and a tab 66 extending from the stem 60 in a direction parallel to the plane of pivoting of the latch 34 about the axis 56. The stem 60 at the pivot end 62 includes the pin hole 63 penetrating therethrough for receiving the pivot pin 54. The tab 66 illustratively forms a wedged-shape and includes an upper surface 68 that is sloped relative to the stem 60 and a lower surface 70 for engaging the connection tube 20 to block removal from the catch receptacle 30.

Returning to FIG. 3, the spring 52 normally biases the latch 34 into the latched position. When the connection tube 20 passes through the open top 42 of the catch receptacle 30, the connection tube 20 contacts the upper surface 68 of the tab 66 and forces the latch 34 into the unlatched position compressing the spring 52. The upper surface 68 is illustratively inclined to translate the downward force of the connection tube 20 pressing thereon into a lateral force (pivotal force) depressing the latch 34 into the unlatched position. Once the connection tube 20 has cleared the open top 42 and is received in the catch receptacle 30, the spring 52 returns the latch 34 into the latched position.

In the latched position of the latch 34, the tab 66 protrudes through the latch opening 50 and extends at least partly across the open top 42 of the catch receptacle 30. When the connection tube 20 is received in the catch receptacle 30 and the latch 34 is in the latched position, the lower surface 70 of the tab 66 can engage the connection tube 20, as shown in FIG. 4, to block removal of the connection tube 20 from the catch receptacle 30. The lower surface 70 is illustratively inclined such that contact with the connection tube 20 is radially directed towards the pivot end 62 of the latch 34 to inhibit upward force from depressing the latch 34 into the unlatched position. However, a user can operate the free end 64 of the stem 60 of the latch 34 to manually compress the spring 52 and place the latch 34 into the unlatched position to permit removal of the connection tube 20 from the catch receptacle 30.

Figure 6:
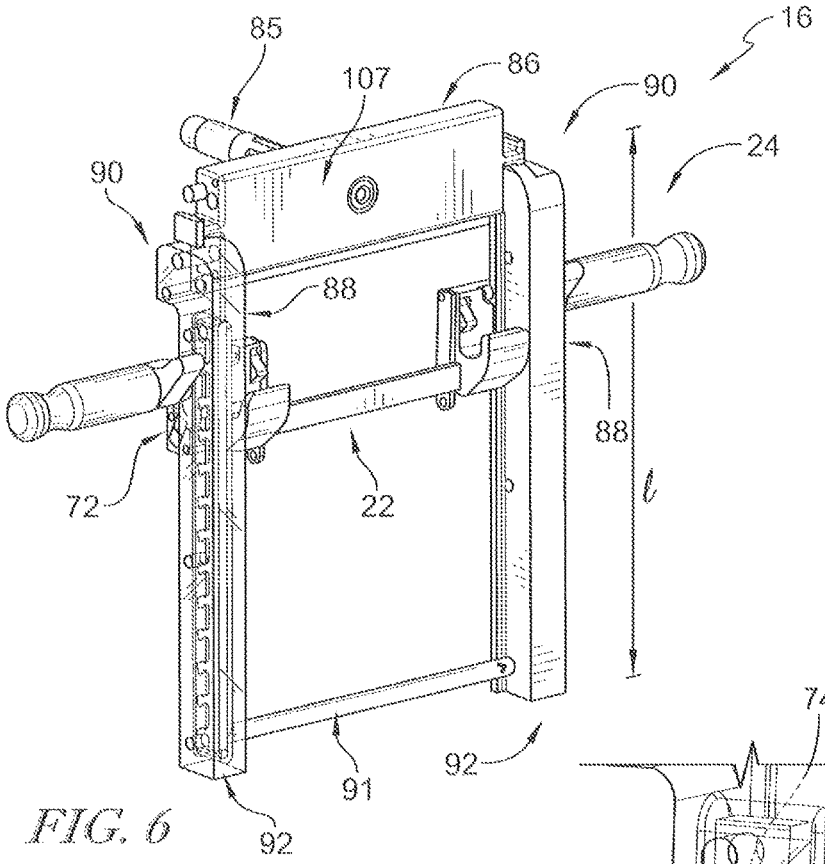
FIG. 6 is a perspective view of the support attachment of FIGS. 1 and 2 showing that the catch assembly is selectively positionable along a length of the support bracket.
Figure 7:
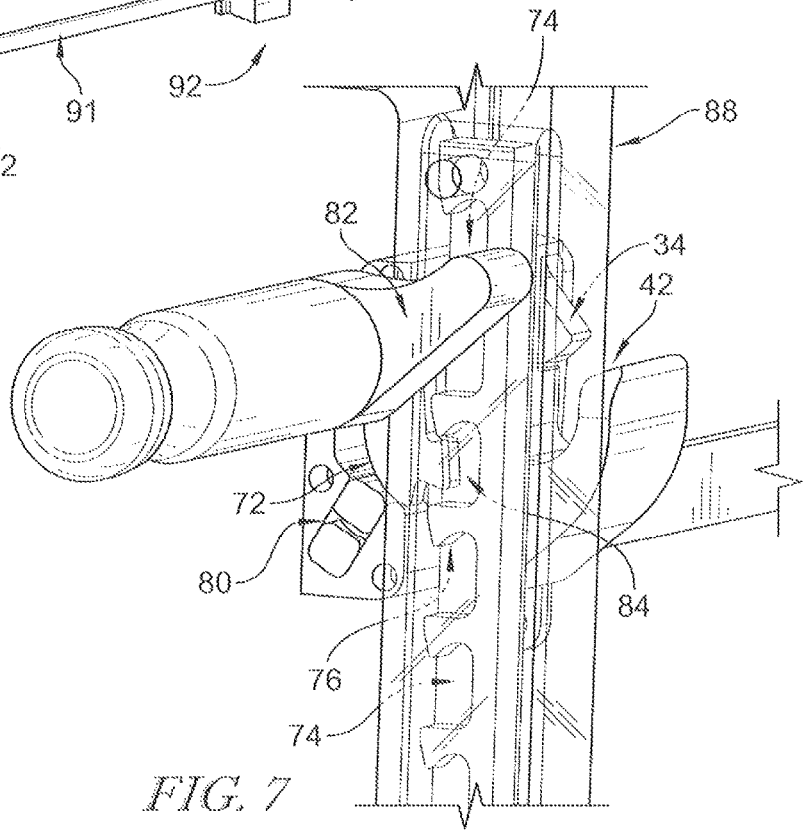
FIG. 7 is a closer perspective view of the support attachment of FIG. 6 with a bracket rail of the support bracket being shown as transparent to illustrate that the support attachment includes a pawl assembly for selectively fixing the position of the catch assembly relative to the support bracket.

Referring to FIGS. 6 and 7, as mentioned above, the catch assembly 22 is coupled to the support bracket 24 for slidable positioning. The catch assembly 22 illustratively includes a pawl 72 for selectively engaging teeth 76 of a ratchet 74 of the support bracket 24 at various discrete positions along the support bracket 24. The pawl 72 is biased by a spring member 80 into an engaged position between the teeth 76 of the ratchet 74 to prevent movement between the catch assembly 22 and the support bracket 24. The catch assembly 22 illustratively includes a lever 82 that is manually pivotable to force the pawl 72 into a disengaged position, out from between the teeth 76, thereby compressing the spring member 80 and releasing the catch assembly 22 for sliding movement along the support bracket 24 between the ends 90, 92 of the bracket rails 88. In the illustrative embodiment as shown in FIG. 7, the ratchet 74 is disposed within a cavity 84 defined in the support bracket 24.

In the illustrative embodiments as shown in FIG. 6, each support bracket 24 is attached to the respective tower base 12 by connection with amounting bar 86 of the respective tower base 12. Each support bracket 24 illustratively includes a pair of bracket rails 88 spaced apart from each other and extending for a length l parallel each other between opposite ends 90, 92, and a bracket strut 91 extending between the bracket rails 88 at each of their opposite end 92. An example of an acceptable mounting bar 86 is disclosed in U.S. Patent Application Publication No. 2013/0269710 to Hight et al., the contents of which are hereby incorporated by reference in their entirety, and at least including the descriptions and figures related to the connection block "283" and related features disclosed therein. In some embodiments, each support bracket 24 may be connected to the respective tower base 12 in any suitable manner.

Figure 8:
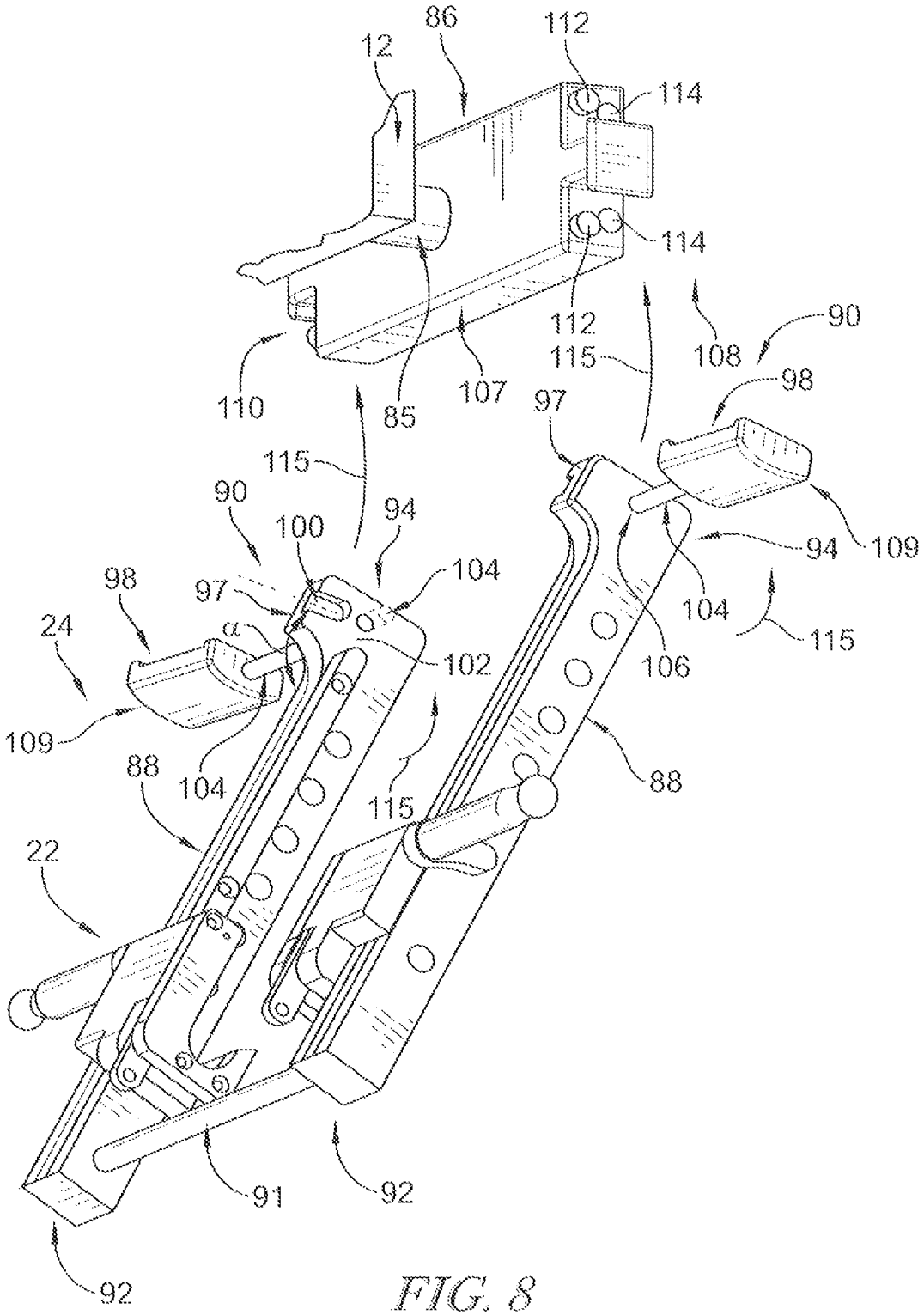
FIG. 8 is rear perspective view of the support attachment of FIGS. 1-7 showing the support bracket spaced beneath a mounting bar of the tower base, showing the support bracket including angled slots that receive pins of the mounting bar and showing the support bracket including retractable locking pins for insertion into holes of the mounting bar to provide connection of the support bracket to the mounting bar.

In the illustrative embodiments as shown in FIG. 8, each bracket rail 88 includes a tilt section 94 for connecting the support brackets 24 to the mounting bar 86. The tilt section 94 illustratively includes a face 97 facing perpendicular to the extension direction of the bracket rail 88. On the tilt section 94, each bracket rail 88 includes a locking pin assembly 98 and a retainer slot 100 defined in an interior surface 102 of the respective bracket rail 88. In the illustrative embodiment, each retainer slot 100 is defined in the interior surface 102 for a length extending from the face 97 at an angle relative to the extension length of the respective bracket rail 88, the angle $\alpha$ illustratively being less than 90 degrees (for example, about 45-85 degrees) to prevent undesired disengagement from the mounting bar 86. Each locking pin assembly 98 includes a locking pin 104 slidably mounted in a pin hole 106 extending through the respective bracket rail 88 and connected to a handle 109 for user operation. A user can selectively operate each locking pin assembly 98 by applying force to the respective handle 109 to slide the locking pin 104 between a retracted position (FIG. 8, shown in solid line, and suggested in FIG. 9) and an extended position (FIG. 8, shown in dotted line; and suggested in FIG. 10).

As shown in FIG. 8, each mounting bar 86 is illustratively attached to the tower base 12 by a rod 85 (the rod 85 being operable for rotation and translation by the tower base 12 to position the support bracket 24 accordingly, for example as disclosed within U.S. Patent Application Publication No. 2013/0269710 by Hight et al., the contents of which are hereby incorporated by reference in their entirety, and at least including the descriptions and figures related to the shaft "212" and related features disclosed therein). Each mounting bar 86 illustratively includes a mounting body 107 extending for a length between opposite ends 108, 110 and two retainer pins 112 extending from each of the opposite ends 108, 110 parallel to the direction of extension of the mounting body 107. Each mounting bar 86 includes a pair of locking holes 114 defined in the opposite ends 108, 110. Each retainer pin 112 is configured for insertion within one of the retainer slots 100 of a respective bracket rail 88, and each locking hole 114 is configured to receive the locking pin 104 of the same respective bracket rail 88 therein for connection of the support bracket 24 to the mounting bar 86.

Figure 9:
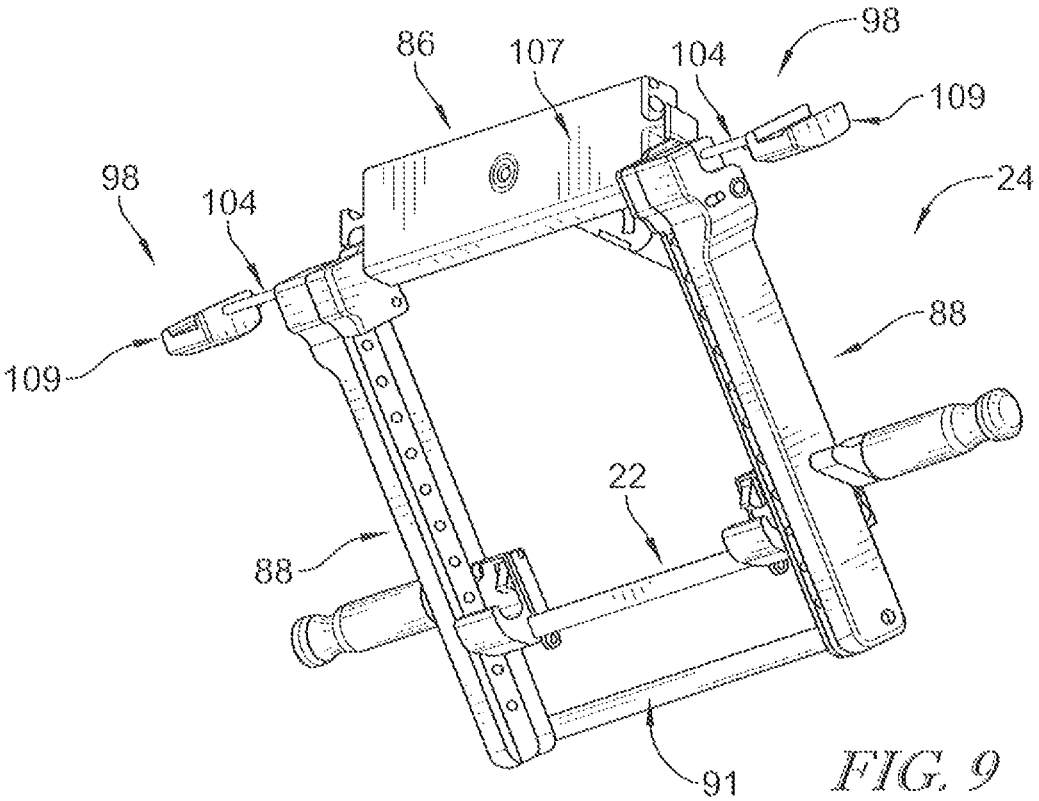
FIG. 9 is a front perspective view of the support attachment of FIG. 8 showing that, to attach the support bracket to the mounting bar, the support bracket is angled and the angled slots are aligned with the pins of the mounting bar while the retractable locking pins are in a retracted position.
Figure 10:
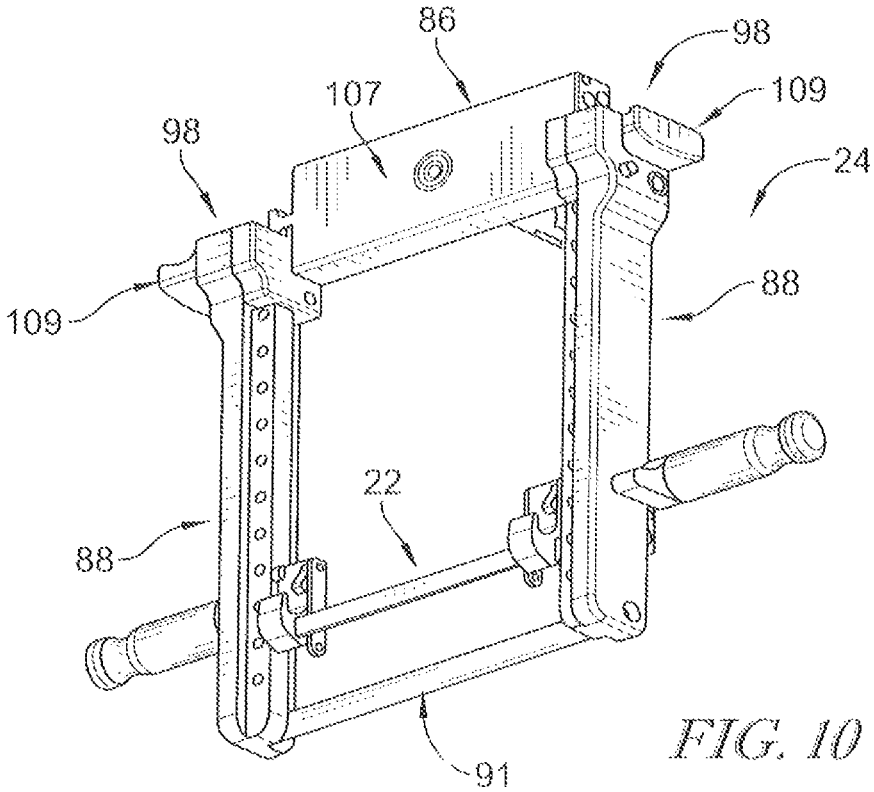
FIG. 10 is a front perspective view of the support attachment of FIG. 9 showing that, to complete attachment of the support bracket to the mounting bar, the mounting bar pins are received within the angled slots of the support bracket, the support bracket is rotated to vertical (in the orientation as shown in FIG. 10), and the retractable locking pins are moved into the holes of the mounting bar to secure the support bracket to the mounting bar.

As suggested in FIGS. 9 and 10, the angle $\alpha$ between the retainer slots 100 and the bracket rails 88 prevent accidental disconnection of the support bracket 24 from the mounting bar 86. To attach the support bracket 24 to the mounting bar 86, a user angles the support bracket 24 and aligns the retainer slots with the 100 retainer pins 112. The user moves the locking pins 104 into the retracted position and pivots the support bracket 24 in the direction indicated by arrows 115 in FIG. 8 to seat the retainer pins 112 within the retainer slots 100 and to align the locking pins 104 with the locking holes 114. Once aligned, as shown in FIG. 10, the user moves the locking pins 104 into the extended position for insertion into the locking holes 114. To remove the support bracket 24, a user reverses the steps mentioned above.

Figure 11:
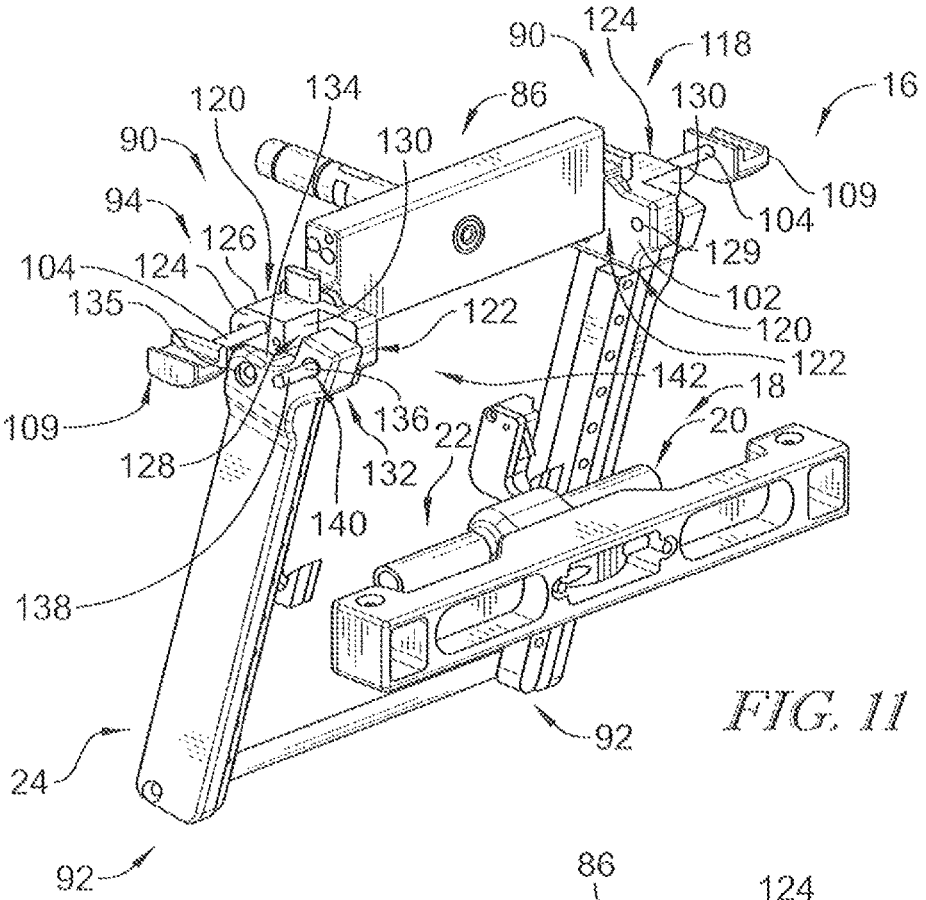
FIG. 11 is a perspective view of the support attachment of FIG. 10 showing the support bracket including a tilt assembly for pivoting the support bracket while the support bracket is attached to the mounting bar to assist connection of the catch assembly with the patient support top and showing that the tilt assembly permits pivoting by placing a connection pin arranged in a disconnection position.
Figure 12:
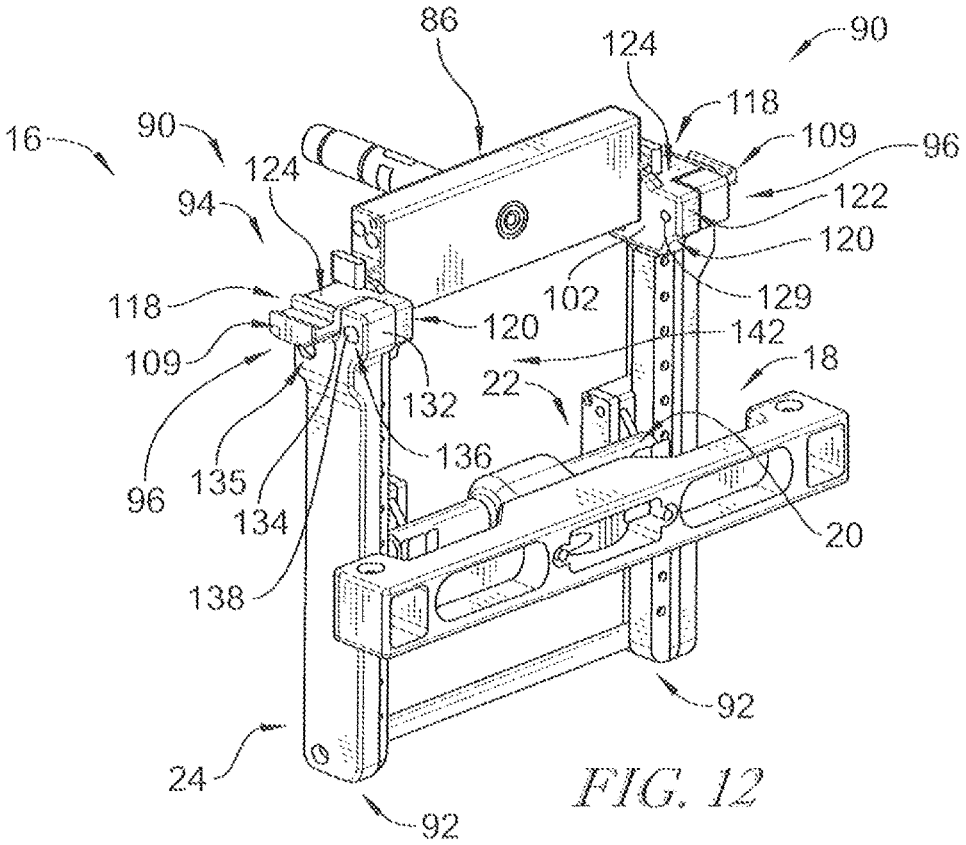
FIG. 12 is a perspective view of the support attachment of FIG. 11 showing that the connection tube is received within the receptacle and that the tilt assembly is arranged to restrict pivoting of the support bracket by the connection pin arranged in a connection position.

Referring now to FIGS. 11 and 12, the support bracket 24 includes a tilt assembly 118 for pivoting the support bracket 24 while the support bracket 24 is attached to the mounting bar 86 to assist connection of the catch assembly 22 with the patient support top 14. The tilt assembly 118 illustratively includes a pair of release gates 120, one of which is pivotably attached to the end 90 of each bracket rail 88 and forming a portion of the tilt section 94 of the respective bracket rail 88. The tilt assembly 118 provides selective pivoting of the support bracket 24 relative to the mounting bar 86 while attached to the mounting bar 86 to permit ease in connecting the patient support top 14 to the support bracket 24, as contrasted with the tilt section 94 that allows pivoting articulation of the support bracket 24 relative to the mounting bar 86 during attachment of these components (support bracket 24 and mounting bar 86) together.

As shown in FIGS. 11 and 12, the release gates 120 of the tilt assembly 118 illustratively each include a frame 122 providing the interior surface 102 of the respective bracket rail 88 that defines the retainer slot 100 therein and a stopper 124 that extends from the frame 122 on an opposite side from the interior surface 102. The stopper 124 illustratively includes a surface 130 facing generally downward in FIGS. 11 and 12 and shaped to define a rabbet 128 of the release gate 120 that is complimentary to the respective bracket rail 88 at the end 90. Each release gate 120 has a bolt hole 129 extending therethrough for fixing the relative positions of the release gates 120 and the bracket rails 88.

As shown in FIGS. 11 and 12, each bracket rail 88 illustratively includes a merlon 132 that extends from the end 90 of the respective bracket rail 88 for joining within the rabbet 128 of the respective release gate 120. Each bracket rail 88 includes a surface 134 shaped complimentary to the surface 130 of the stopper 124 for engagement therewith when the merlon 132 is joined within the rabbet 128. In the illustrative embodiment shown in FIGS. 11 and 12, the surfaces 130, 134 are curved, but in some embodiments may have any suitable complimentary shape.

In the illustrative embodiment shown in FIGS. 11 and 12, each bracket rail 88 of the support bracket 24 is pivotably connected to one of the release gates 120 by a pin 135 for pivoting between a disconnection position (as shown in FIG. 11) and a connection position (as shown in FIG. 12). The merlon 132 of each bracket rail 88 illustratively includes a bolt latch 136 that is positionable between a disconnected position that does not extend from the merlon 132 for reception within the bolt hole 129 of the release gate 120 (as shown in FIG. 11) and a connected position (as shown in FIG. 12) in which the bolt latch 136 extends from the merlon 132 into the bolt hole 129 of the release gate 120 to releasably fix the bracket rails 88 against pivoting relative to the release gates 120.

The bolt latch 136 illustratively includes a bolt 138 slidably disposed in a bolt opening 140 of the merlon 132. In the illustrative embodiment, in the disconnected position each bolt 138 is positioned within the respective merlon 132 (i.e., not within the bolt hole 129) and the bracket rails 88 can pivot relative to the release gates 120. In the connected position, the bolts 138 project from the merlons 132 into the bolt holes 129 of the release gates 120. When the support bracket 24 is in the connection position (as shown in FIG. 12) and the bolt 138 is in the connected position, the bolt 138 extends into the bolt hole 129 of the respective release gate 120, fixing the position of the bracket rails 88 of the support bracket 24 for pivoting relative to the release gate 120. A user can operate the bolt latches 136 into the disconnected position out of the bolt holes 129 to release the pivoting motion of the support bracket 24 for connection and disconnection of the coupler assembly 18 of the patient support top 14 with the support bracket 24.

In FIGS. 13-21 another illustrative embodiment of support attachments 1016 adapted for use in the patient support device 10 is shown. The support attachments 1016 are similar to the support attachments 16 as disclosed herein. Accordingly, the description of the support attachments 16 illustratively applies to the support attachments 1016, except in instances of conflict with the specific disclosure of the support attachments 1016.

Each support attachment 1016 illustratively connects with the mounting bar 86 of one of the tower bases 12 and is configured to selectively connect with the patient support top 14. Each support attachment 1016 illustratively includes a catch assembly 1022 slidably attached to a support bracket 1024 and selectively positionable along the length l of the support bracket 1024. The catch assembly 1022 locks at discrete, spaced positions along the length l of the support bracket 1024. The catch assembly 1022 of each support attachment 1016 is illustratively embodied as a top-loading catch assembly operable to selectively secure the patient support top 14 with the tower bases 12.

Figure 13:
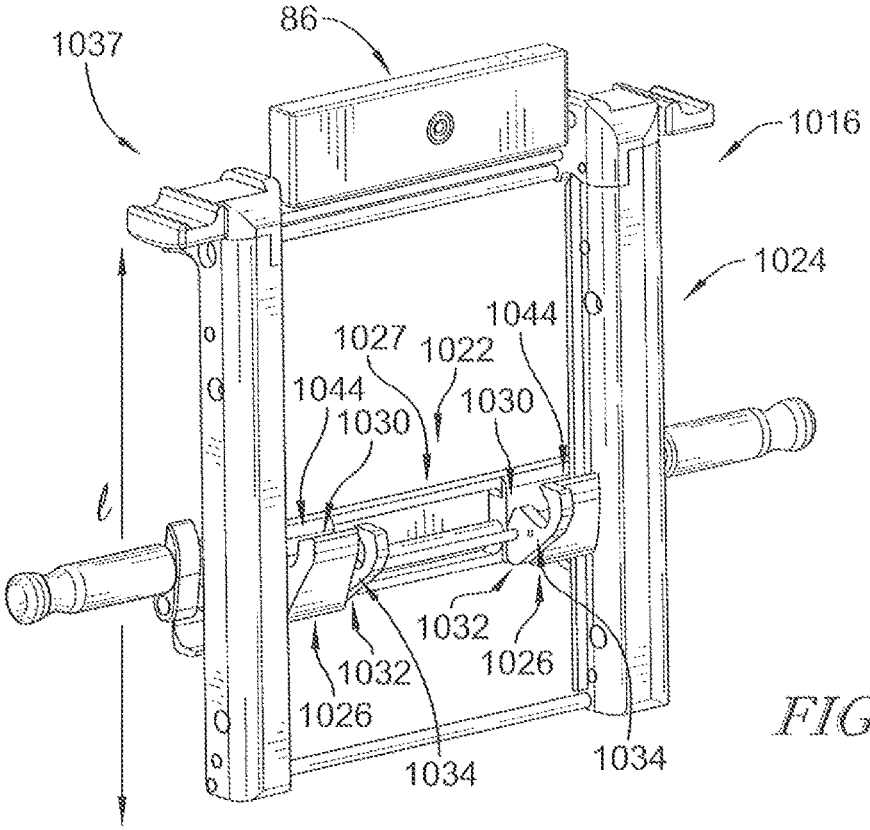
FIG. 13 is a front perspective view of another support attachment adapted for use with the patient support system of FIG. 1 showing the support attachment including a support bracket and a catch assembly attached to the support bracket and having a main body, a pair of catch holds, and a latch assembly.
Figure 14:
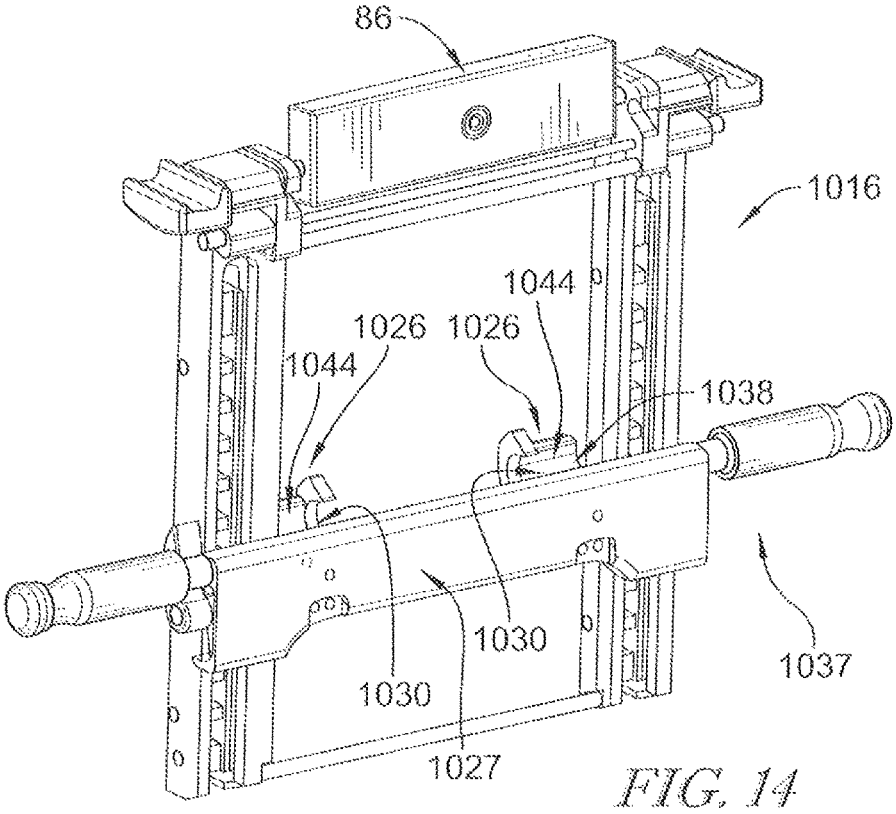
FIG. 14 is a rear perspective view of the support attachment of FIG. 13 showing the catch assembly defining a receptacle for receiving the connection tube of the patient support top.
Figure 19:
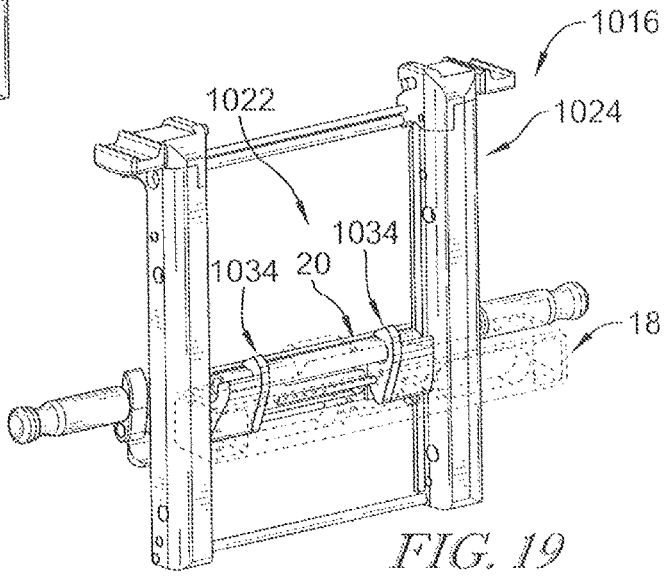

As best shown in FIGS. 13 and 14, the catch assembly 1022 illustratively includes a main body 1027 and a pair of catch holds 1026 extending from the main body 1027 in spaced apart relation from each other. A user can manually operate the main body 1027 to selectively fix the position of the catch assembly 1022 along the length l of the support bracket 1024. The pair of catch holds 1026 extend from the main body 1027 to define a catch receptacle 1030 for receiving the connection tube 20. As best shown in FIG. 19, the catch receptacle 1030 illustratively includes the space which the connection tube 20 occupies while received by the catch assembly 1022.

As shown in FIGS. 13 and 14, the catch assembly 1022 illustratively includes a latch assembly 1032 having pivotable latches 1034. In the illustrative embodiment, one of the latches 1034 is pivotably connected to each respective catch hold 1026. The latches 1034 are illustratively operable between an unlatched position (as shown in FIG. 13) for receiving insertion of the connection tube 20 into the catch receptacle 1030 and a latched position (as shown in FIG. 14) for blocking removal of the connection tube 20 from the catch receptacle 1030.

Figure 15:
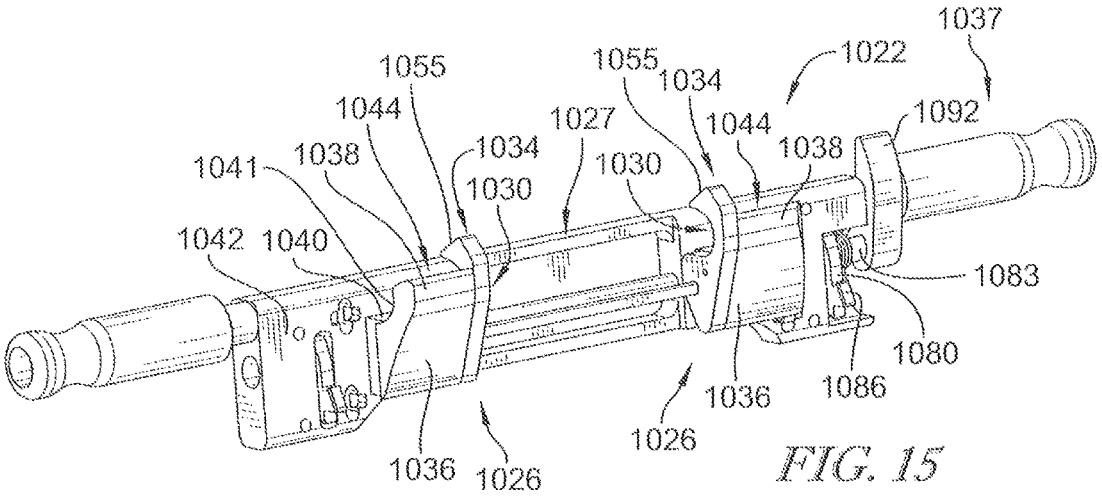
FIG. 15 is a front perspective view of the catch assembly of the support attachment of FIGS. 13 and 14.

As shown in FIG. 15, each catch hold 1026 illustratively includes a catch body 1036 and a catch arm 1038 that extends from the catch body 1036 to form the catch receptacle 1030. The catch arm 1038 illustratively extends from the catch body 1036 at a location away from the main body 1027 of the catch assembly 1022 and extends vertically (in the orientation shown in FIG. 15) to define a portion of the catch receptacle 1030.

Figure 16:
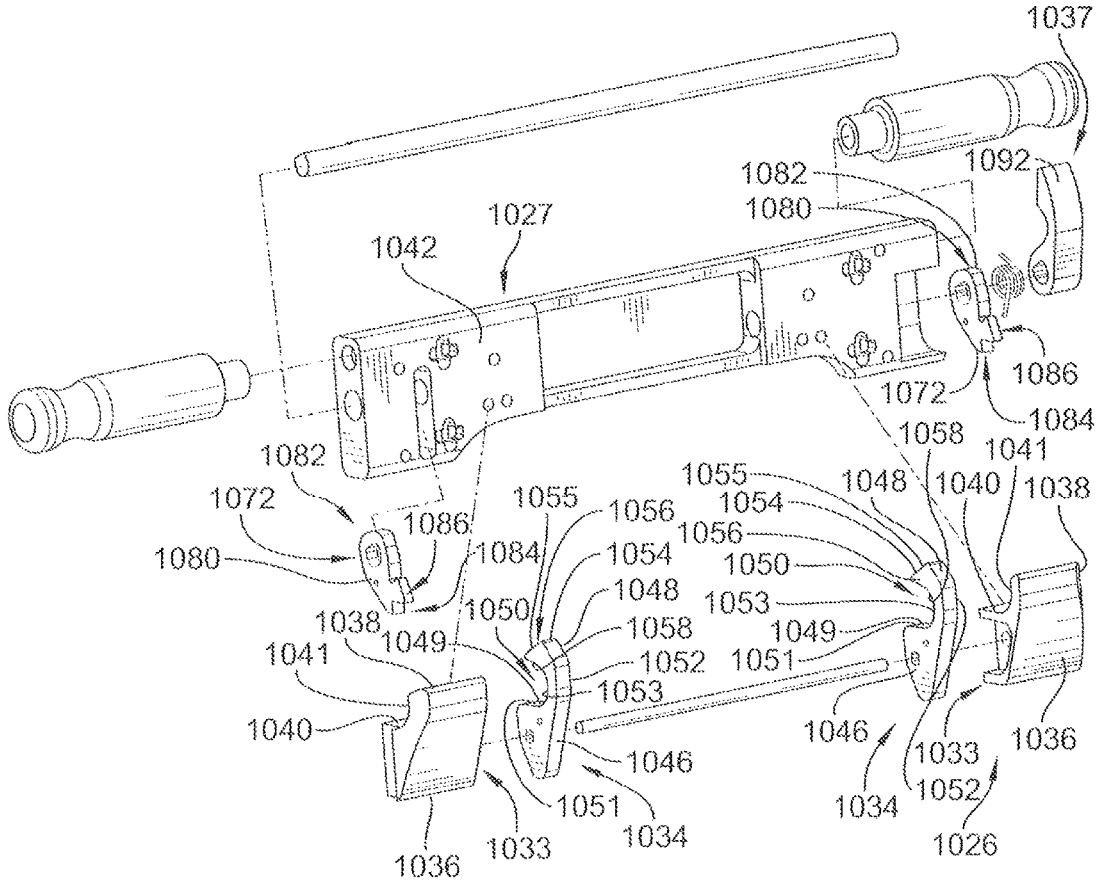
FIG. 16 is an exploded perspective view of the catch assembly of the support attachment of FIGS. 13-15.

In the illustrative embodiment shown in FIGS. 15 and 16, each catch body 1036 includes a top surface 1040 and each catch arm 1038 includes a side surface 1041. The corresponding top surface 1040 and side surface 1041 of a respective catch hold 1026 together define portions of the catch receptacle 1030 and engage with the connection tube 20 when received within the catch receptacle 1030. The catch body 1036 illustratively attaches to the main body 1027 at a location proximate to a side 1037 of the catch assembly 1022.

As shown in FIGS. 15 and 16, the main body 1027 includes a front surface 1042 that collectively defines, together with the corresponding top surface 1040 and side surface 1041 of each respective catch hold 1026, the catch receptacle 1030 to generally have a U-shape that is complimentary to the shape of the connection tube 20 and such that the catch receptacle 1030 has an open top 1044 for insertion of the connection tube 20. In some embodiments, the catch receptacle 1030 may be defined to have any suitable shape for receiving the connection tube 20.

As mentioned above, in the illustrative embodiment shown in FIGS. 15 and 16, the latches 1034 of the respective latch assembly 1032 are pivotably attached to an interior side 1033 of the catch body 1036. Each latch 1034 illustratively includes a base 1046 formed of a plate and an arm 1048 that extends from the base 1046 to define a latch receptacle 1050. The base 1046 together with the arm 1048 include a continuous surface 1049 that defines the latch receptacle 1050.

In the illustrative embodiment, the arm 1048 of each latch 1034 illustratively includes a stem 1052 connected to the base 1046 and an arc 1054 attached to the stem 1052. The stem 1052 extends from a first end connected to the base 1046 vertically (in the orientation as shown FIGS. 15 and 16) to a second end that is opposite the first end. The stem 1052 illustratively includes an interior surface 1053 that defines a portion of the surface 1049.

As shown in FIG. 16, the arc 1054 is illustratively connected to the second end of the stem 1052 opposite the base 1046 and extends from the stem 1052 to a free end 1056. The arc 1054 illustratively includes an interior surface 1058 that forms a portion of the surface 1049. The interior surface 1058 of the arc 1054 is formed to have a concave shape complimentary to the shape of the connection tube 20.

In the illustrative embodiment shown in FIGS. 15 and 16, the interior surface 1053 of the stem 1052, the interior surface 1058 of the arc 1054, and a top surface 1051 of the base 1046 collectively form the continuous surface 1049. In the illustrative embodiment, the top surface 1051 of the base 1046 is arranged parallel to the top surface 1040 of the catch body 1036 and the interior surface 1053 of the stem 1052 is arranged parallel to the side surface 1041 of the catch body 1036.

As shown in FIG. 14, when the latch 1034 is in the latched position, the top surface 1051 of the base 1046 is aligned with the top surface 1040 of the catch body 1036 to form a continuous bottom surface and the interior surface 1053 of the stem 1052 is aligned with the side surface 1041 of the catch arm 1038 to form a continuous side surface, in the latched position, the arc 1054 of the latch 1034 is positioned to extend at least partly across the open top 1044 to block removal of the connection tube 20 from the catch receptacle 1030. As shown in FIG. 13, when the latch is in the unlatched position, the top surface 1051 of the base 1046 is out of alignment with the top surface 1040 of the catch body 1036 and the interior surface 1053 of the stem 1052 is out of alignment with the side surface 1041 of the catch arm 1038.

Figure 17:
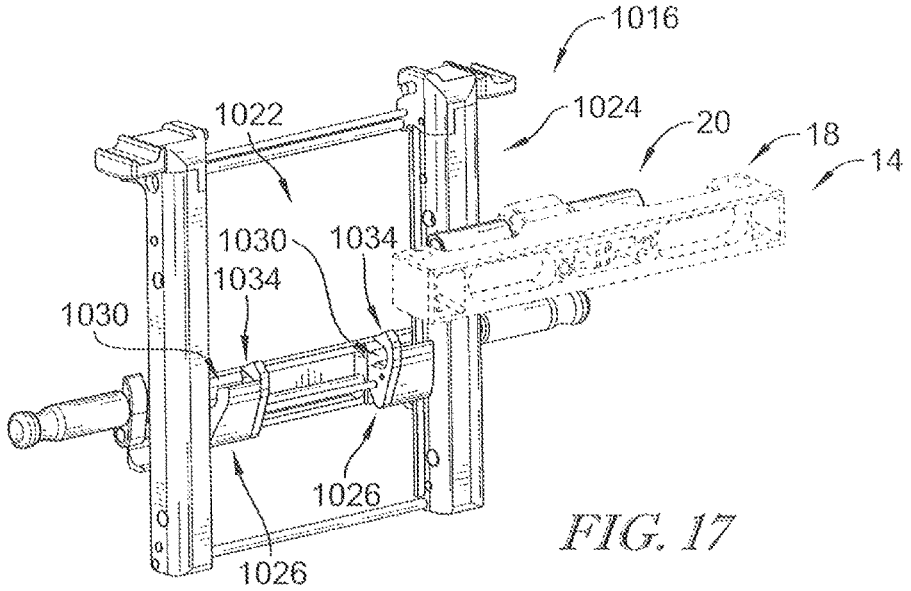
FIGS. 17-19 are front perspective views of the support attachment of FIGS. 13 and 14 showing connection between the connection tube of the patient support top and the catch assembly of the support attachment receiving the connection tube within the receptacle and engaging the latch assembly to block removal of the connection tube from the receptacle.
Figure 18:
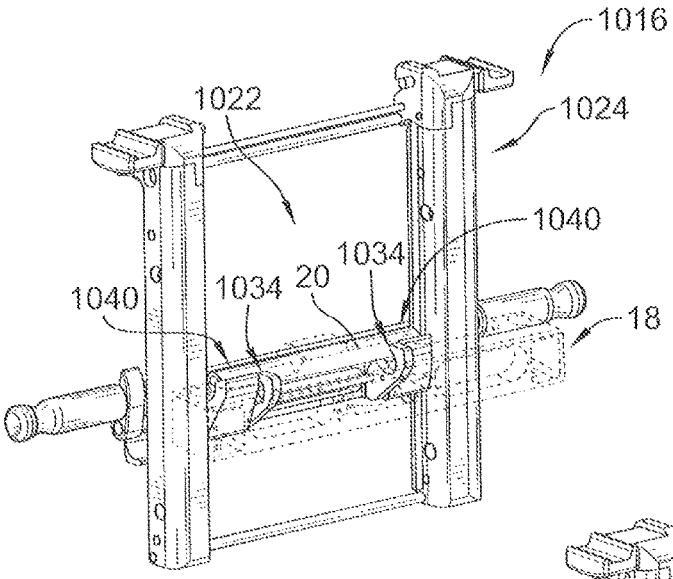

Connection of the patient support top 14 with the catch assembly 1022 is illustratively shown in FIGS. 17-19. In FIG. 17, the catch assembly 1022 is illustratively arranged to accept the connection tube 20 of the patient support top 14 within the catch receptacle 1030. The latches 1034 are illustratively arranged in the latched position prior to engagement between the catch assembly and the patient support top 14. In FIG. 18, the connection tube 20 illustratively contacts the latches 1034 of the catch assembly 1022. The connection tube 20 illustrative contacts the are 1054 of each latch 1034 and rotates the latches 1034 against a biasing member into the unlatched position as the connection tube 20 passes through the open top 1044 for reception within the catch receptacle 1030. In the illustrative embodiment, top surfaces 1055 (shown in FIGS. 15 and 16) of the arcs 1054 are sloped to encourage the latches 1034 into the unlatched position upon contact by the connection tube 20. The interior surfaces 1058 of the arcs 1054 are illustratively not sloped such that upward force from the connection tube 20 is radial to the pivot point of the latches 1034, inhibiting unlocking by upward force alone. Once the connection tube 20 is received within the catch receptacle 1030, the latches 1034 are illustratively biased into the latched position to block removal of the connection tube 20 out of the catch receptacle 1030 as shown in FIG. 19.

Figure 20:
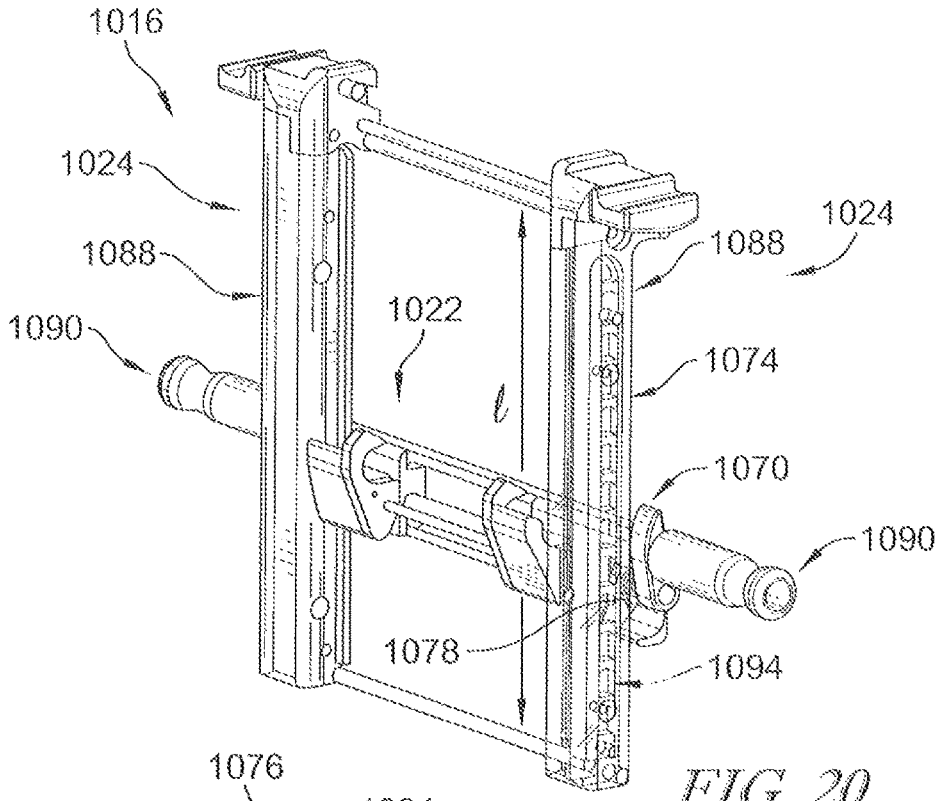
FIG. 20 is a perspective view of the support attachment of FIGS. 13, 14, and 17-19 illustrating a rail of the support bracket as transparent to show that the support attachment includes a pawl assembly including a pawl of the catch assembly and a ratchet of the support bracket and showing that the pawl assembly is operable to selectively fix the position of the catch assembly along the length of the support bracket.
Figure 21:
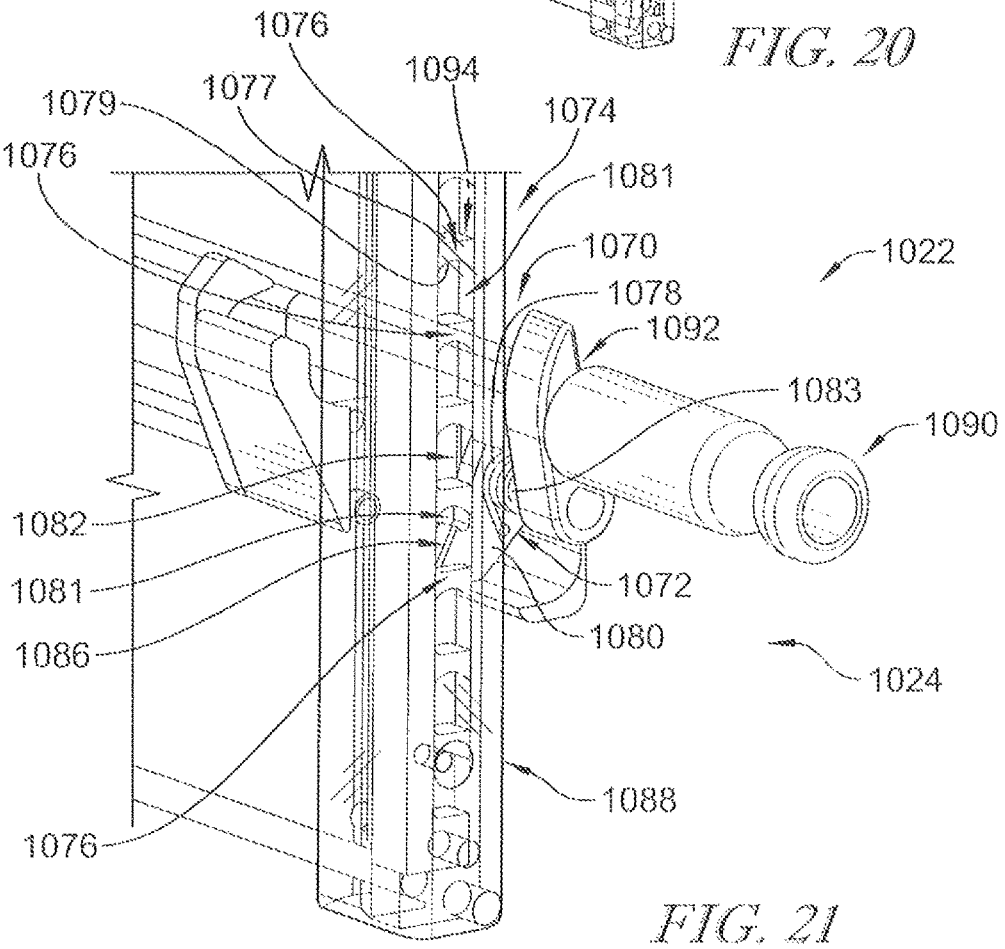
FIG. 21 is a closer perspective view of a portion of the support attachment of FIG. 20 showing that the pawl of the catch assembly engages with teeth of the ratchet to secure the position of the catch assembly relative to the support bracket and showing that removal of the pawl from engagement with the ratchet is restricted to prevent unintended movement of the catch assembly relative to the support bracket.

Referring to FIGS. 20 and 21, as mentioned above, the catch assembly 1022 is coupled to the support bracket 1024 for slidable positioning. The catch assembly 1022 illustratively includes a pawl assembly 1070 including a pair of pawls 1072 for selectively engaging teeth 1076 of ratchets 1074 of the respective bracket rail 1088 of the support bracket 1024 at various discrete positions along the support bracket 1024. The pawls 1072 are biased by a spring member 1078 into an engaged position (as shown in FIG. 20) between consecutive teeth 1076 of the ratchet 1074 to prevent relative movement between the catch assembly 22 and the support bracket 24 and are manually operable by a user into a disengaged position (as shown in dashed line in FIG. 23) out from between the teeth 76 to permit sliding of the catch assembly 1022 along the length l of the support bracket 1024.

As best shown in FIG. 16, each pawl 1072 illustratively includes a pawl lever 1080 having a pivot end 1082 and a free end 1084 opposite the pivot end 1082, and a pawl head 1086 that extends from the pawl lever 1080 proximate to the free end 1084 for selective engagement with the teeth 1076 of the respective bracket rail 1088 (as shown in FIG. 21). The pivot end 1082 illustratively receives a rod 1083 therethrough that is mounted for rotation with main body 1027 and to which the pawl lever 1080 and a trigger 1092 are fixed for rotation therewith. The pawl head 1086 is illustratively formed to have a triangular shape, but in some embodiments may have any suitable shape for engagement with the teeth 1076 to prevent unintentional disengagement as described herein. In some embodiments, a single pawl and ratchet may be used.

As shown in FIGS. 20 and 21, the ratchet 1074 of the support bracket 1024 receives the pawl 1072 to provide selective anchoring of the catch assembly 1022 along the length l of the support bracket 1024. The teeth 1076 of each ratchet 1074 are illustratively disposed within the respective bracket rail 1088 of the support bracket 1024 and are arranged consecutively along the length l of the bracket rail 1088.

Figure 22:
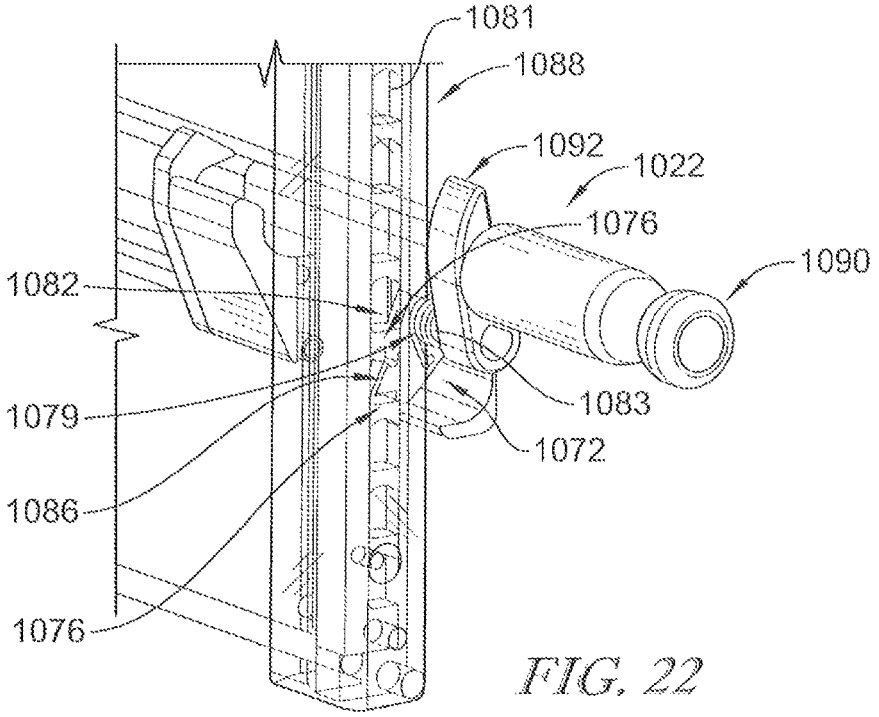
FIG. 22 is a perspective view of the support attachment of FIG. 20 showing that the catch assembly has been raised relative to the support bracket so that a head of the pawl floats within a gap defined between adjacent teeth of the ratchet.
Figure 23:
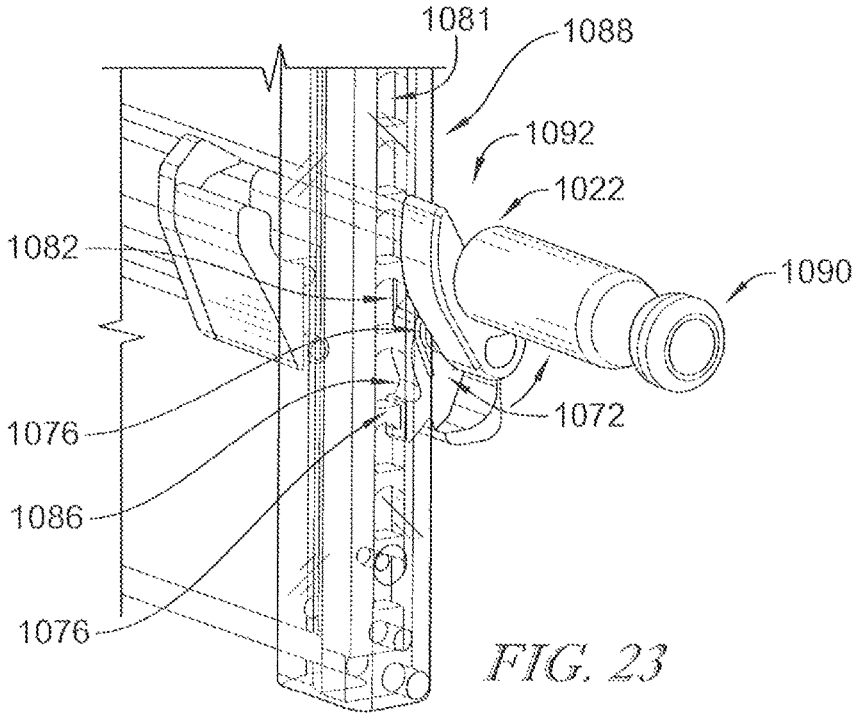
FIG. 23 is a perspective view of the support attachment of FIG. 22 showing that by raising the catch assembly relative to the support bracket so that a head of the pawl floats within the gap defined between adjacent teeth of the ratchet a rotational path of the pawl permits the pawl to disengage from the ratchet to allow sliding movement of the catch assembly along the length of the support bracket.

As shown in FIGS. 22 and 23, the catch assembly 1022 illustratively includes a trigger 1092 pivotable to rotate the pawl 1072 about its pivot end 1082 between an engaged position (engaged with the teeth 1076, as shown in FIG. 21) and a disengaged position (out from engagement with the ratchet 1074, as shown in FIG. 23) compressing the spring member 79 and releasing the catch assembly 22 for sliding movement along the support bracket 24. The trigger 1092 is connected at one end to a rod 1083 that is attached to the pawl lever 1080 at the pivot end 1082 to transfer rotational force therebetween. The teeth 1076 of the ratchet 1074 are illustratively disposed within a cavity 1094 defined in the support bracket 1024.

In the illustrative embodiment, the triangular shape of the pawl head 1086 and the pivoting path of the pawl lever 1080 about the pivot end 1082 prevent the removal of the pawl 1072 from the ratchet 1074 without unloading the weight on the catch assembly 1022 as shown in FIG. 21. A user can apply force to the grips 1090 to unload the weight on the catch assembly 1022 to float the pawl head 1086 between the teeth 1076 of the ratchet 1074 and apply force to the trigger 1092 to rotate the pawl 1072 out of engagement with the ratchet 1074 to release the catch assembly 1022 for sliding movement along the support bracket 1024 as shown in FIG. 22. The user can select a relative position of the catch assembly 1022 and release the trigger 1092 to allow the spring to bias the pawl 1072 into engagement with the teeth 1076 at the corresponding position, preventing relative movement between the catch assembly 1022 and the support bracket 1024.

As shown in FIG. 21, the teeth 1076 each illustratively include a flat surface 1077 and a curved surface 1079 disposed on opposite sides thereof. In the illustrative embodiment, the curved surfaces 1079 of each tooth 1076 face downward and the flat surfaces 1077 face upward in the orientation shown in FIG. 21. The teeth 1076 are illustratively arranged in a consecutive line within the cavity 1094 in spaced apart arrangement from the adjacent teeth 1076 to define a pawl space 1081 therebetween for receiving the pawl head 1086. The pawl head 1086 is blocked from removal from the pawl space 1081 when engaged with either of the flat or curved surfaces 1077, 1079 according to the rotational path of the pawl head 1086 and/or the corresponding shapes of the pawl head and surfaces 1077, 1079. Thus, requiring unloading of weight and slight centering of the pawl heat 1086 within the pawl space 1081 such that rotation of the pawl lever 1080 into the disengaged position does not cause contact between the pawl head 1086 and the surfaces 1077, 1079 inhibits unintentional sliding of the catch assembly 1022 relative to the support bracket 1024.

FIGS. 24-27 show another illustrative embodiment of a pair of support attachments 2016 adapted for use in the patient support device 10. The support attachments 2016 are similar to the support attachments 16, 1016 as disclosed herein. The description of the support attachments 16, 1016 apply to the support attachments 2016, except in instances of conflict with the specific disclosure of the support attachments 2016.

Each support attachment 2016 illustratively connects with the mounting bar 86 of one of the tower bases 12 and is configured to selectively connect with the patient support top 14. Each support attachment 2016 illustratively includes a catch assembly 2022 slidably attached to a support bracket 2024. The catch assembly 2022 of each support attachment 2016 is illustratively embodied as a bottom-loading catch assembly operable to selectively secure the patient support top 14 with the tower bases 12.

Figure 24:
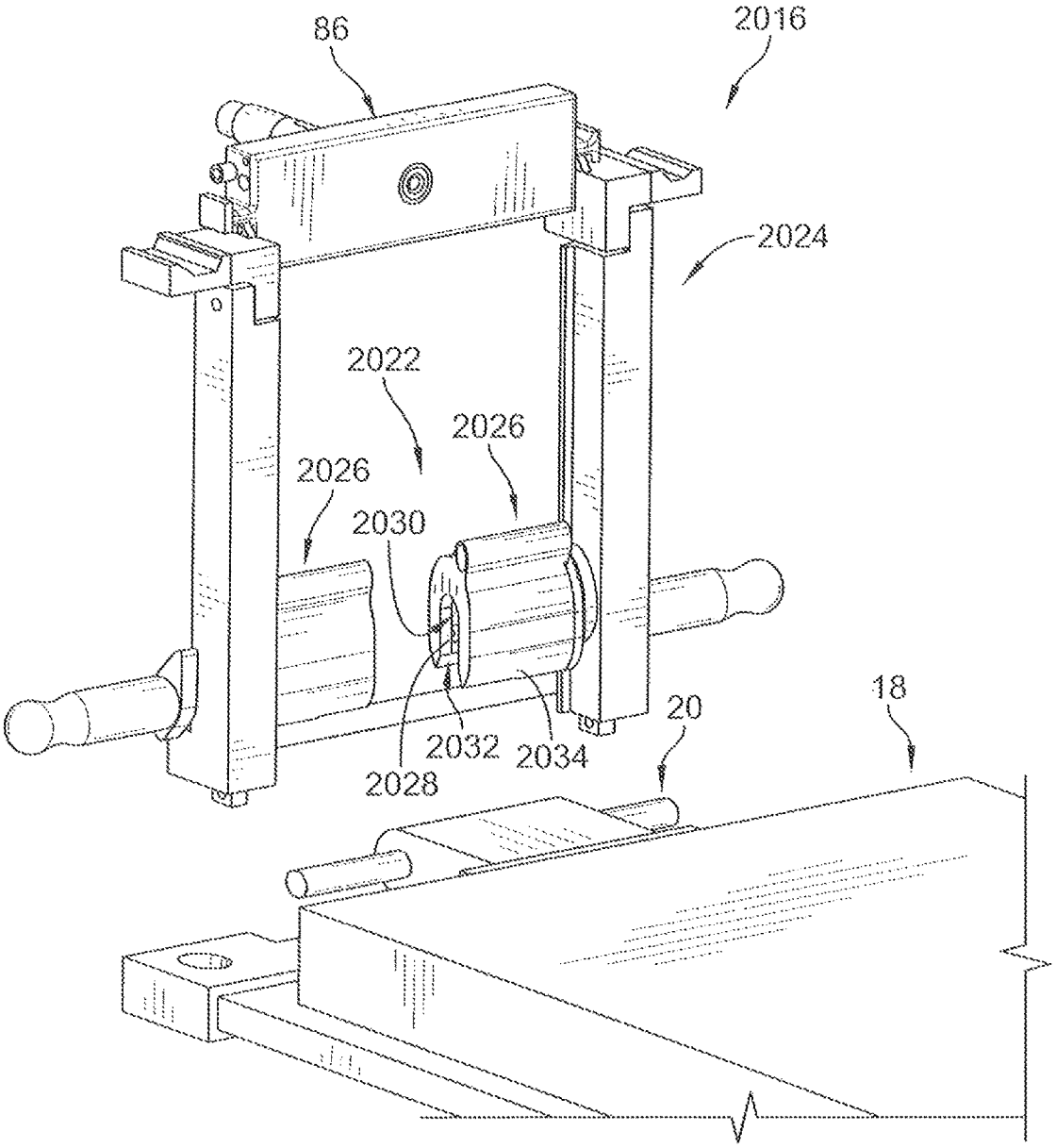
FIG. 24 is a perspective view of another support attachment adapted for use in the patient support device of FIG. 1 showing that the support attachment includes a support bracket and a bottom-loading catch assembly including a pair of catch holds that define a receptacle for receiving the connector of the patient support top.

As shown in FIG. 24, each catch assembly 2022 illustratively includes a pair of catch housings 2026 and a locking catch 2028 disposed for rotation within each catch housing 2026. Each catch housing 2026 defines a catch receptacle 2030 embodied as an internal space therein for insertion of the connection tube 20 and a slot 2032 extending radially between the catch receptacle 2030 and an exterior wall 2034 of the catch housing 2026. The slot 2032 is illustratively embodied as a passage through which the connection tube 20 can enter into the catch receptacle 2030. With the connection tube 20 received within the catch receptacle 2030, a user can manually rotate the locking catch 2028 into position to impede the slot 2032 to prevent removal of the connection tube 20 from the catch receptacle 2030.

Figure 25:
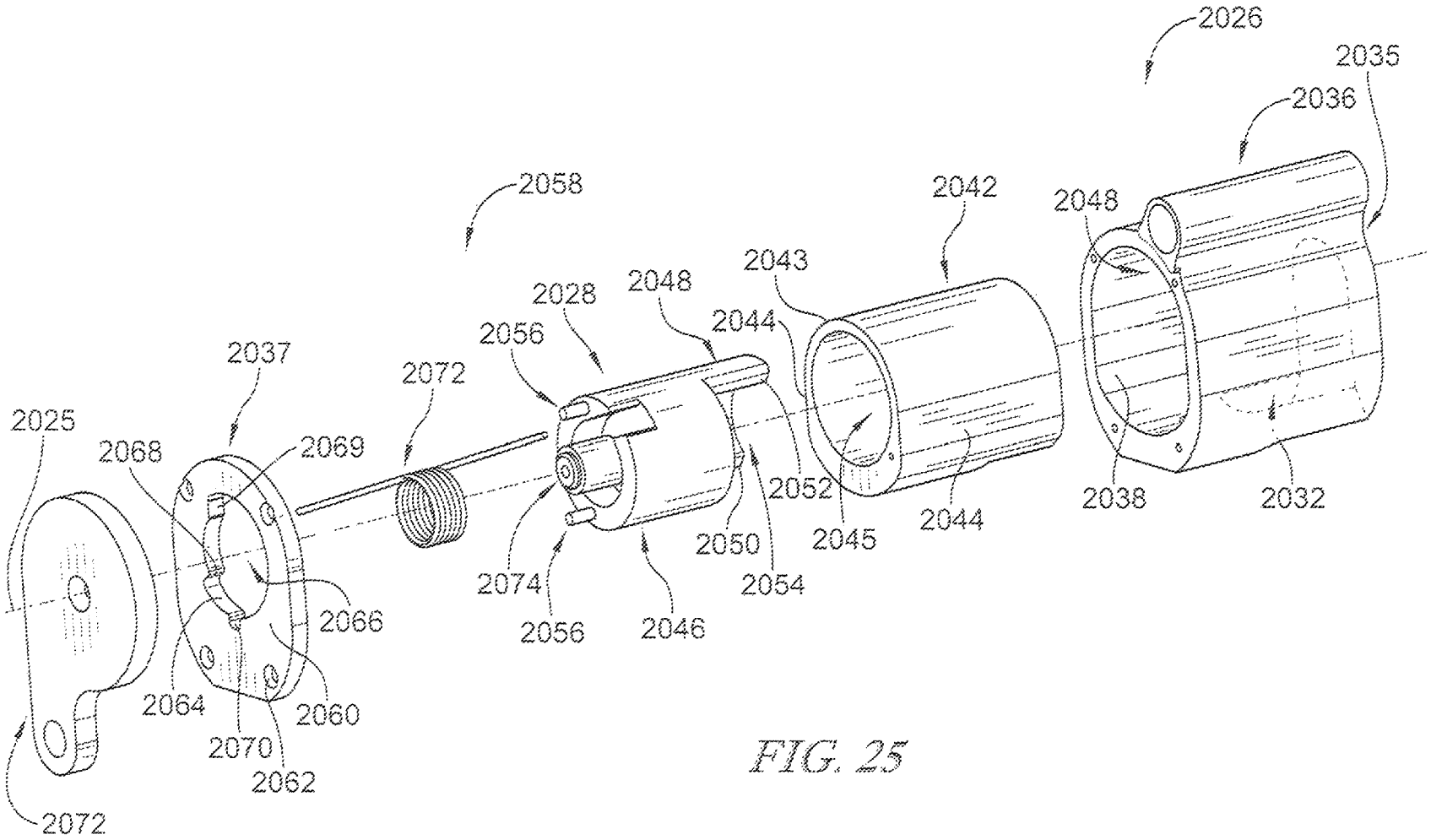
FIG. 25 is an exploded perspective view of a catch hold of the catch assembly of the support attachment of FIG. 24 showing each catch hold including a housing that receives a receiver and defines the receptacle and a slot, and a locking catch including an arm that is axially aligned with the slot, the locking catch being operable to rotate within the receiver to selectively align the angular position of the arm to block the slot and prevent removal of the connection tube from the receptacle or to misalign the arm with the slot to allow the connection tube to pass through the slot.

As best shown in FIG. 25, each catch housing 2026 illustratively includes a housing cover 2036 having a cavity 2040 defined therein and a housing receiver 2042 positioned within the cavity 2040. The housing cover 2036 illustratively includes a body 2035 having an interior surface 2038 that defines the cavity 2040 and a closure 2037 that attaches to the body 2035 to secure the housing receiver 2042 within the cavity 2040.

The housing receiver 2042 is illustratively embodied to as a hollow tube including a tube wall 2043 extending longitudinally along an axis 2025 to define an interior space 2045 and having exterior surfaces 2044 disposed opposite each other for engagement with the housing cover 2036. The cavity 2040 is illustratively shaped complimentary to the shape of the housing receiver 2042 to permit the housing receiver 2042 to translate within the cavity 2040 relative to the housing cover 2036 along the vertical direction in the orientation as shown in FIG. 25. The exterior surfaces 2044 of the housing receiver 2042 are illustratively flat surfaces that engage with the interior surface 2038 of the housing cover 2036 to prevent rotation of the housing receiver 2042 relative to the housing cover 2036. Allowing the housing receiver 2042 to translate, but not rotate, relative to the housing cover 2036 provides security against accidental release of the connection tube 20 from the catch receptacle 2030, as explained in detail below.

In the illustrative embodiment as shown in FIG. 25, each locking catch 2028 is rotatably received within the interior space 2045 of the respective housing receiver 2042 and fixed against vertical translation relative thereto. Each locking catch 2028 illustratively includes a body 2046 illustratively formed as a cylinder extending longitudinally along the axis 2025 and an arm 2048 that extends from the body 2046 for a length in the direction of the axis 2025. The arm 2048 is illustratively embodied as a wall formed circumferentially around the axis 2025 and having circumferential ends 2050, 2052 that define a gap 2054 therebetween. The locking catch 2028 are illustratively positioned within the catch hold 2026 such that the arm 2048 and the gap 2054 of the locking catch 2028 are axially aligned with the slot 2032 of the catch housing 2026. A user can rotate the locking catch 2028 about the axis 2025 to circumferentially (angularly) align either the arm 2048 or the gap 2054 with the slot 2032 of the catch housing 2026 to selectively unlock and lock the catch assembly 2022.

Figure 26:
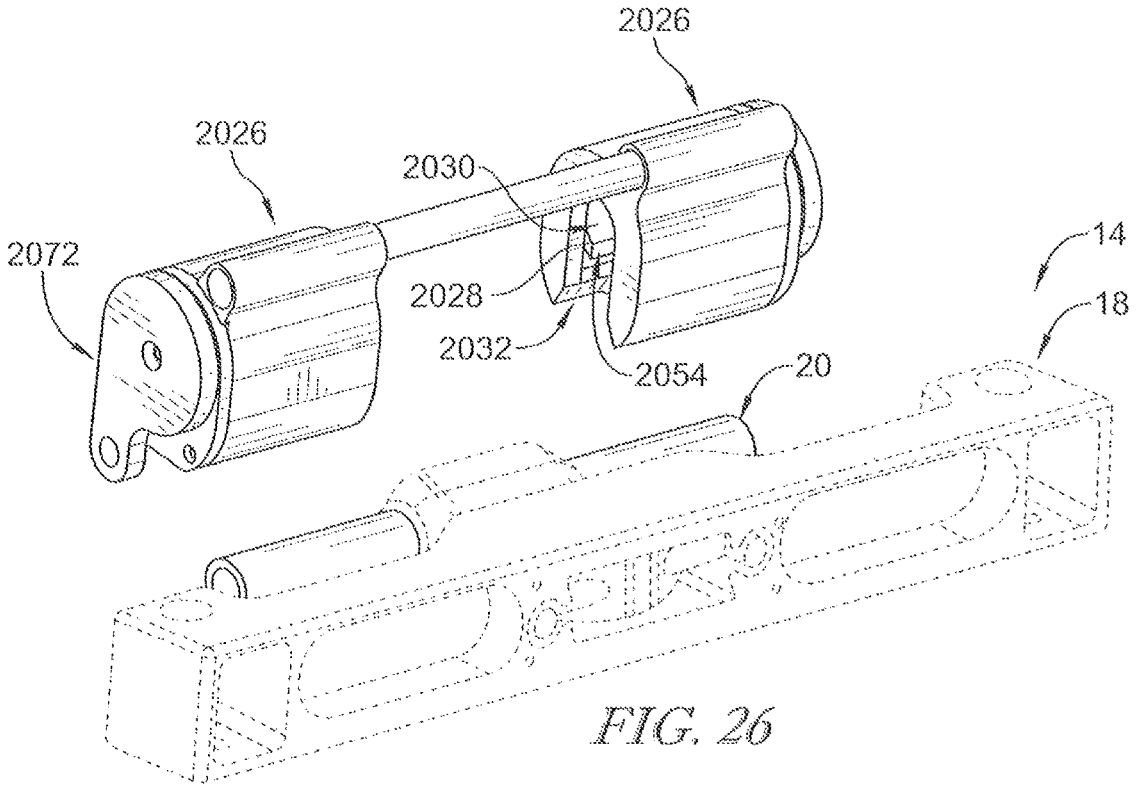
FIG. 26 is a perspective view of the catch assembly of FIGS. 24 and 25 showing the locking catches misaligned with the slot to allow the connection tube to pass through the slot.
Figure 27:
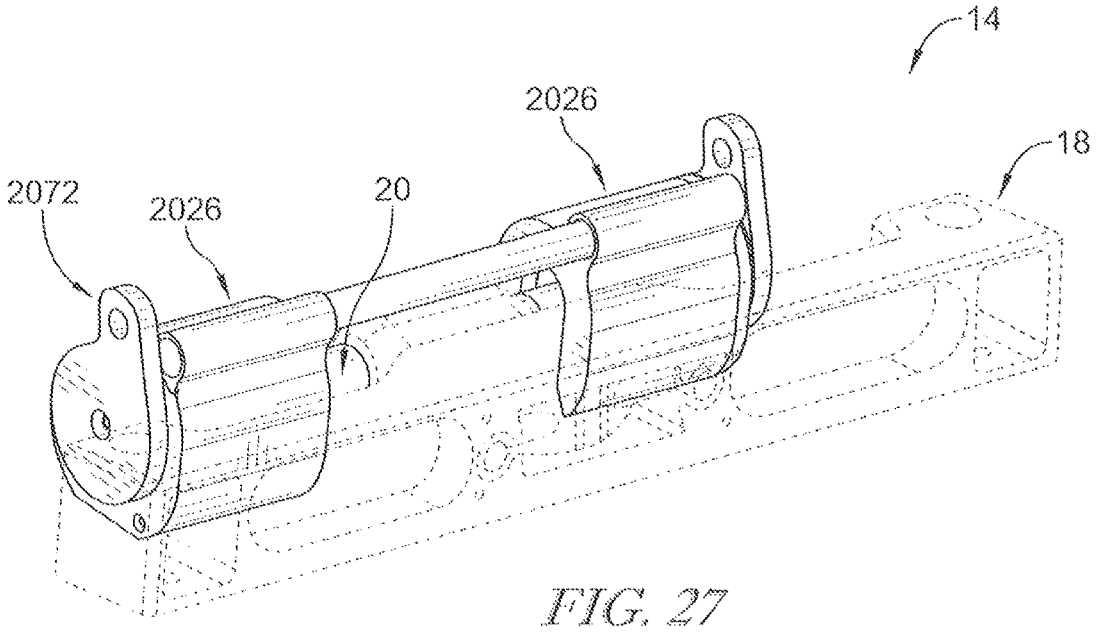
FIG. 27 is perspective view of the catch assembly of FIG. 26 showing the connection tube received within the receptacle and the locking catches operated to align the arms with the slot to block removal of the connection tube from the receptacle.

A user can selectively rotate the locking catch 2028 between an unlocked position (as shown in FIG. 26) in which the gap 2054 is circumferentially aligned with the slot 2032, and a locked position (as shown in FIG. 27) in which the arm 2048 is circumferentially aligned with the slot 2032. In the unlocked position, as shown in FIG. 26, the arm 2048 is illustratively positioned at an angular position about the axis 2025 different from the angular position of the slot 2032 to permit passage of the connection tube 20 upwardly through the slot 2032 and into the catch receptacle 2030. In the unlocked position, as suggested in FIG. 27, the arm 2048 is illustratively positioned at an angular position about the axis 2025 corresponding to the angular position of the slot 2032 to impede the connection tube 20 from passing through the slot 2032. When the connection tube 20 is within the catch receptacle 2030 and the locking catch 2028 is in the locked position, the connection tube 20 is blocked against removal from the catch receptacle 2030.

Referring to FIG. 25, the catch assembly 2022 illustratively includes a security clutch 2058 that discourages accidental unlocking of the catch assembly 2022. The security clutch 2058 illustratively includes portions of the locking catch 2028 and the closure 2037 configured to interact with each other to require a user to unload the catch assembly 2022 (and, thus, to unload a connected patient support top 14) before permitting rotation of the locking catch 1028 out of the locked position.

In the illustrative embodiment, the locking catch 2028 illustratively includes a pair of posts 2056 that extend from an end of the body 2046 opposite the arm 2048. The posts 2056 are each illustratively connected to the body 2046 at different angular positions relative to the axis 2025 to exert leverage on the body 2046 in rotation about the axis 2025. The posts 2056 illustratively interact with the closure 2037 to provide the security clutch 2058.

The closure 2037 illustratively includes a closure body 2060 having fastener holes 2062 defined axially therethrough for receiving fasteners for attachment to the body 2046 and having an interior surface 2064 that defines a keyhole 2066 axially penetrating through the closure body 2060. The keyhole 2066 illustratively receives the posts 2056 of the locking catch 2028 for interaction with the interior surface 2064. The interior surface 2064 of the keyhole 2066 illustratively defines abutments 2068, 2069 and a crevice 2070.

The abutments 1068, 1069 are illustratively arranged at angular positions relative to each other and the posts 2056 such that engagement of one of the posts 2056 with the abutment 2068 defines an angular position of the locking catch 2028 that corresponds with the unlocked position and engagement of the other post 2056 with the abutment 2069 defines an angular position of the locking catch 2028 that corresponds with the locked position. The abutment 2069 and the crevice 2070 are each arranged at angular positions corresponding to the angular position of one of the posts 2056 about the axis 2025. In the illustrative embodiment, the abutments 2068, 2069 are positioned with a smaller radial distance from the axis 2025 than the crevice 2070.

When one of the posts 2056 is positioned in the crevice 2070, rotation of the locking catch 2028 relative to the housing cover 2036 is restricted. In the illustrative embodiment, the crevice 2070 is positioned at the 6 o'clock position as depicted in FIG. 25. When the catch housing 2026 is in the locked position, the weight of the catch housing 2026 (and the force transmitted by the connection tube 20 if present within the catch receptacle 2030) urges the post 2056 into the crevice 2070 restricting rotation of the locking catch 2028. Thus, when the catch housing 2026 is in the looked position, the weight of the patient support top 14 (including any load it supports, for example, a patient) that is connected to the catch assembly 2022 naturally inhibits the locking catch 2028 from being accidentally operated into the unlocked position. In order to rotate the locking catch 2028 out of the locked position, a user must lift the housing receiver 2042 vertically to translate the housing receiver 2042 relative to the housing cover 2036 to translate the post 2056 out of the crevice 2070, thereby releasing the locking catch 2028 for rotation. By arranging the force of the patient support top 14 to work in the direction to urge the post 2056 into the crevice 2070, the force of a patient occupying the patient support top 14 discourages accidental unlocking of the catch assembly 2022.

As shown in FIG. 25, each catch hold 1026 illustratively includes a lever 2072 fixed against rotation to a shaft 2074 of the locking catch 2028. Each catch housing 2026 illustratively includes a spring 2076 biasing the locking catch 2028 into the locked position. A user can operate the lever 2072 to transmit rotation to the locking catch 2028 via the shaft 2074 to oppose the force of the spring 2076 to rotate the locking catch 2028 into the unlocked position.

As shown in FIG. 26, a user rotates each locking catch 2028 into the unlocked position to receive the connection tube 20 to pass through the slot 2032 and into the catch receptacle 2030. As shown in FIG. 27, a user can move the connection tube 20 into the catch receptacle 2030 and release the levers 2072 to allow the springs 2076 to bias the locking catches 2028 into the locked position to block removal of the connection tube 20 from the catch receptacle 2030.

Another illustrative embodiment of support attachments 3016 adapted for use in the patient support device 10 is shown in FIGS. 28-31. The support attachments 3016 are similar to the support attachments 16, 1016, 2016 as disclosed herein. The description of the support attachments 16, 1016, 2016 apply to the support attachments 3016 except in instances of conflict with the specific disclosure of the support attachments 3016.

Figure 28:
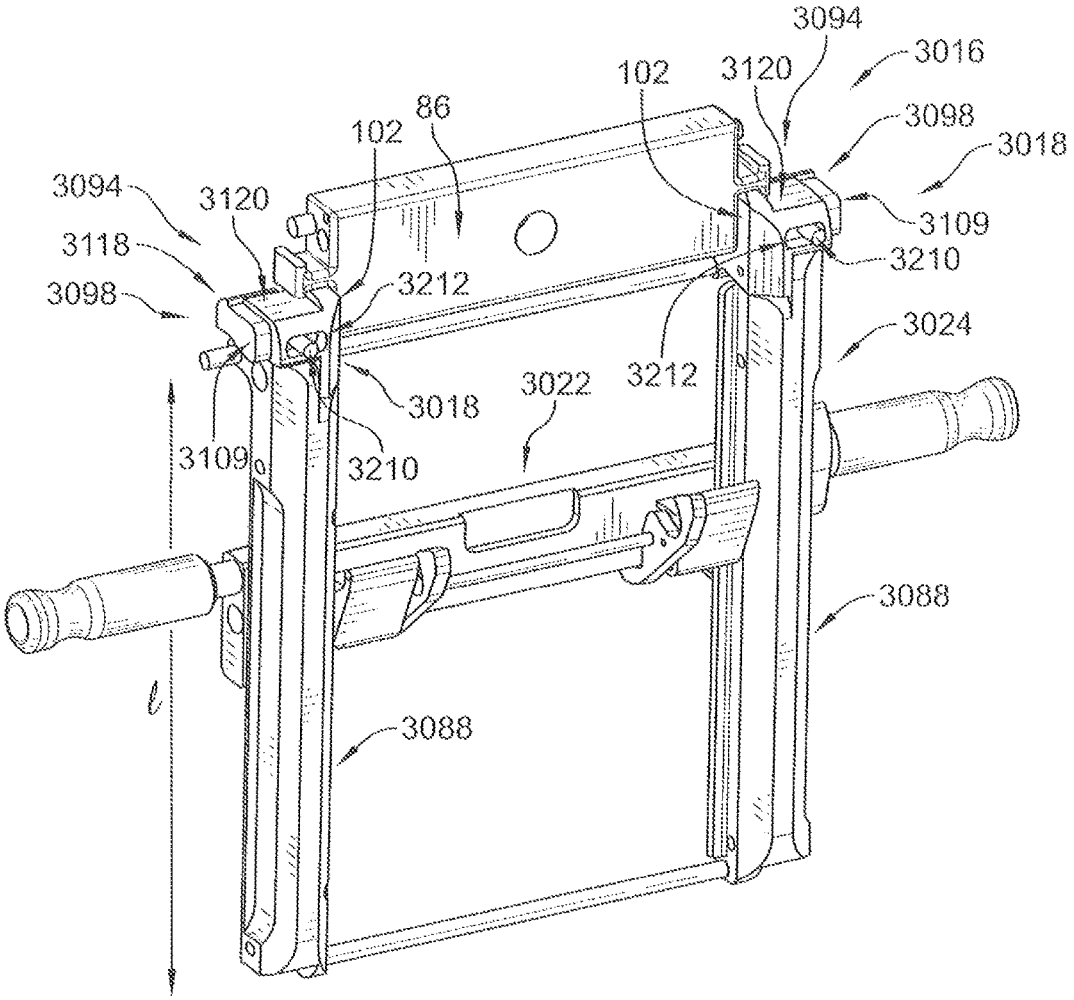
FIG. 28 is a perspective view of another support attachment adapted for use with the patient support system of FIG. 1 showing a support bracket coupled to the mounting bar of the tower base and a catch assembly for connection to the patient support top and showing the support bracket including bracket rails having a tilt section for connecting the support bracket to the mounting bar and a tilt assembly for permitting pivoting of the support bracket while it is attached to the mounting bar to assist connection of the catch assembly with the patient support.

As shown in FIG. 28, each support attachment 3016 illustratively connects with the mounting bar 86 of the tower bases 12 and is configured to selectively connect with the patient support top 14. Each support attachment 3016 illustratively includes a catch assembly 3022 slidably attached to a support bracket 3024 and selectively positionable along a length l of the support bracket 3024. The catch assembly 3022 of each support attachment 3016 is illustratively embodied as a top-loading catch assembly operable to selectively secure the patient support top 14 with the tower bases 12.

Each support bracket 3024 illustratively includes a pair of bracket rails 3088 spaced apart from each other and extending parallel to each other for the length l. In the illustrative embodiment as shown in FIG. 28, each bracket rail 3088 includes a tilt section 3094 having a lock pin assembly 3098 and a retainer slot 100 defined on an interior surface 102 thereof for attaching the support bracket 3024 to the mounting bar 86. Each retainer slot 100 is illustratively defined in the interior surface 102 for a length extending from a face 97 of the respective bracket rail 3088 at an angle relative to the extension length of the respective bracket rail 3088, the angle illustratively being less than 90 degrees to prevent undesired disengagement from the mounting bar 86.

Figure 29:
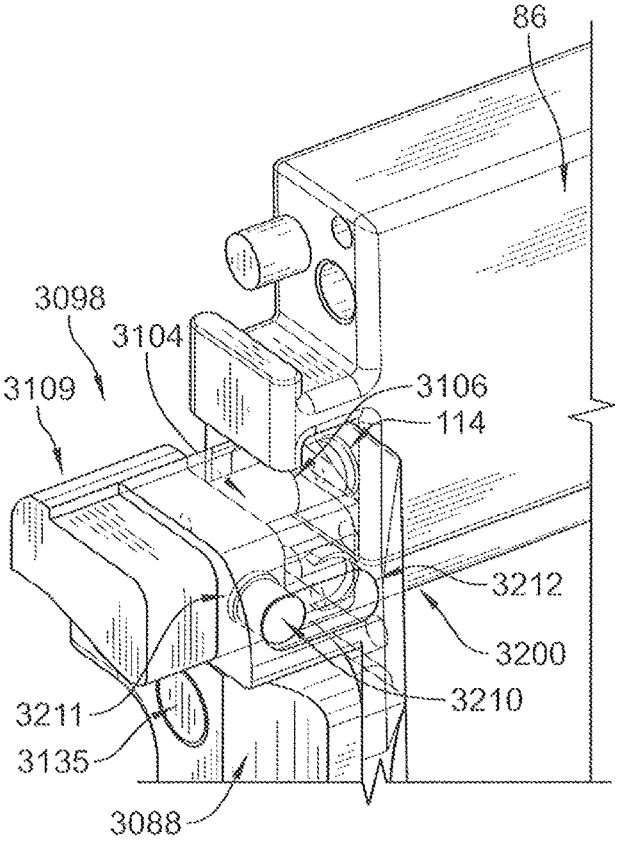
FIG. 29 is a closer perspective view of the tilt section of the support attachment of FIG. 28 showing the tilt section including a locking pin assembly for selectively connecting the support bracket to the mounting bar and a safety latch assembly for selectively restraining operation of the locking pin assembly to prevent unintended disengagement between the support bracket and the mounting bar, showing a safety pin of the safety latch assembly arranged in an unlatched position in which it is depressed into the bracket rail, and showing the safety pin translated to the left side of a pin slot of the safety latch assembly to remove a locking pin of the locking pin assembly from engagement with the mounting bar.
Figure 30:
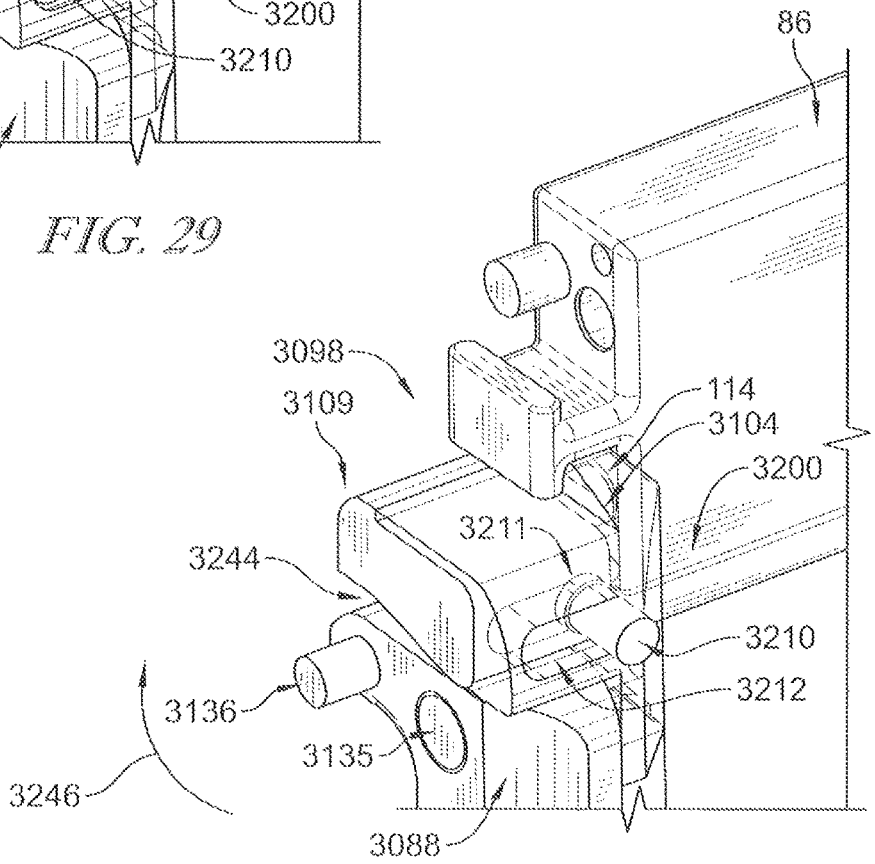
FIG. 30 is a perspective view of the tilt section of the support attachment, similar to FIG. 29, showing the safety pin in a latched position in which it is extended from the bracket rail to restrain the locking pin assembly from removal out of engagement with the mounting bar.

As shown in FIGS. 29 and 30, each lock pin assembly 3098 includes locking pin 3104 connected to a handle 3109 for user operation and slidably received in a pin hole 3106 that extends through a release gate 3120 of the respective bracket rail 3088 and is aligned with the locking hole 114 of the mounting bar 86. A user can selectively operate each lock pin assembly 3098 by applying force to the respective handle 3109 to slide the locking pin 3104 between a retracted position withdrawn from the locking hole 114 (as shown in FIG. 30) and an extended position inserted within the locking hole 114 (as shown in FIG. 29) to selectively attach the support bracket 3024 to the mounting bar 86.

As shown in FIGS. 29 and 30, each lock pin assembly 3098 illustratively includes a safety latch assembly 3200 for selectively preventing removal of the locking pin 3104 out from the locking hole 114 of the mounting bar 86. Each safety latch assembly 3200 illustratively includes a safety pin 3210 and a pin slot 3212 defined by the bracket rail 3088 to receive the safety pin 3210 for reciprocation and translation therein. Each safety pin 3210 is illustratively slidably received within a hole 3211 of the respective handle 3109 and extends perpendicularly to the direction of the locking pin 3104 through the pin slot 3212. The safety pin 3210 is operable between an unlatched position (as shown in FIG. 29) in which the safety pin 3210 is depressed into pin slot 3212 of the bracket rail 3088 to allow translating movement of the locking pin 3104 and a latched position (as shown in FIG. 30) in which the safety pin 3210 extends from the pin slot 3212 and engages a latch receptacle 3224 defined therein (as described in detail below) to prevent removal of the locking pin 3104 from the locking hole 114 without depression of the safety pin 3104.

Figure 31:
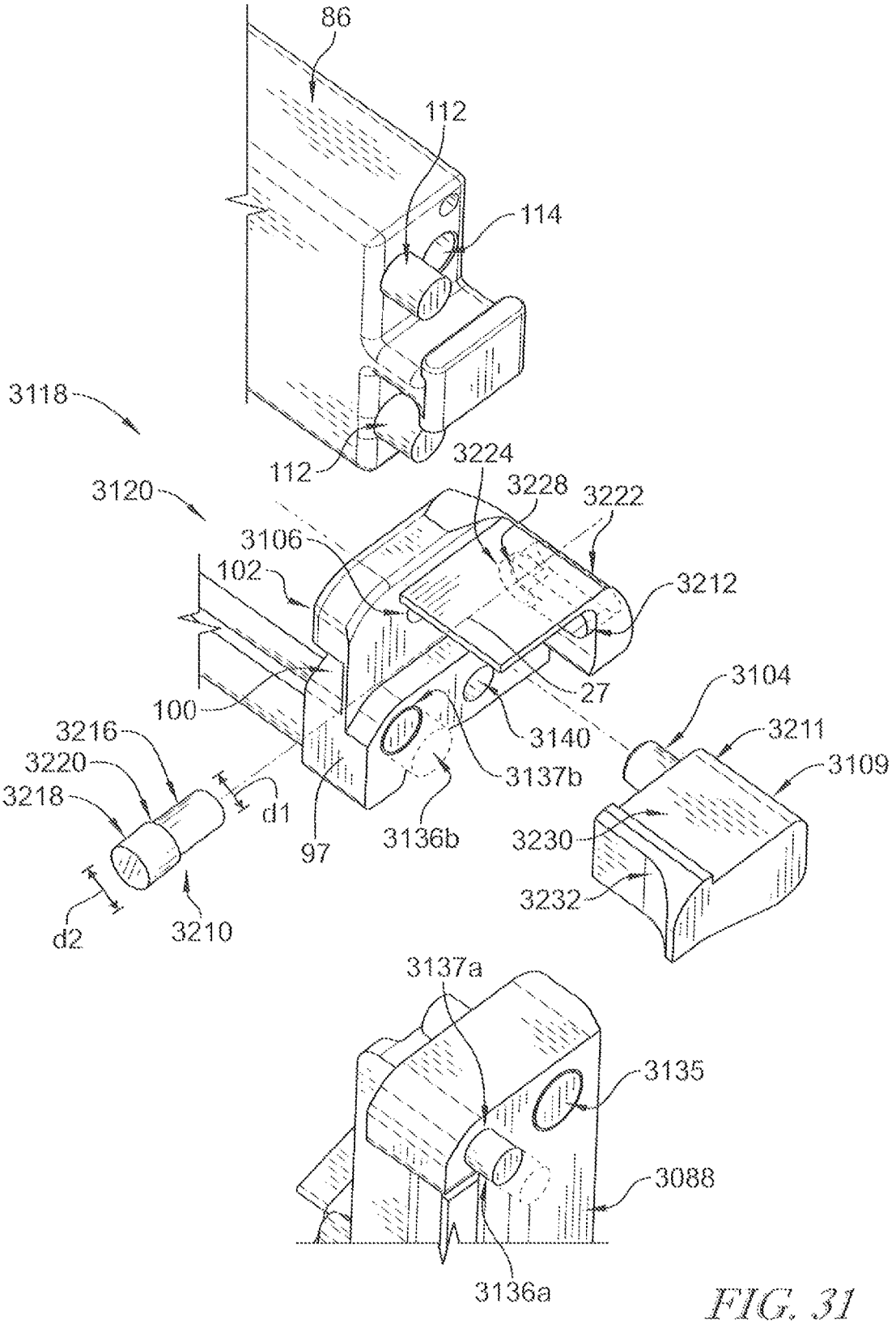
FIG. 31 is an exploded perspective view of the tilt section and the tilt assembly of the support attachment of FIGS. 28-30 showing the tilt assembly including a pin latch that receives the safety pin therein for selective translation and reciprocation to latch and unlatch the locking pin assembly.

In the illustrative embodiment as shown in FIG. 31, the safety pin 3210 is embodied as a stepped shaft including a first section 3216 having a first diameter $d_1$ and a second section 3218 having a second diameter $d_2$ larger than the first diameter $d_1$ and defining a step 3220 extending between and connecting the first section 3216 with the second section 3218. The step 3220 illustratively selectively engages with the latch receptacle 3224 of the respectively release gate 3120 to prevent removal of the locking pin 3104 from the locking hole 114.

As shown in FIG. 28, the support attachments 3016 each illustratively include a tilt assembly 3118 for pivoting the support bracket 3024 while attached to the mounting bar 86 to assist connection of the catch assembly 3022 with the patient support top 14 (as discussed below). The tilt assembly 3118 illustratively includes a pair of release gates 3120, one of each being pivotably connected to each bracket rail 3088 on a connection end thereof. The release gates 3120 illustratively provide the interior surface 102 of the respective bracket rail 3088 that defines the retainer slot 100 as described above regarding support bracket 24.

In the illustrative embodiment as shown in FIG. 30, the release gates 3120 illustratively define the pin slots 3212. Each pin slot 3212 illustratively includes a slide receptacle 3222 that is shaped to receive the safety pin 3210 for transverse movement (corresponding to the position of the respective handle 3109) therein and a latch receptacle 3224 connecting with the slide receptacle 3222 and shaped to receive the safety pin 3210 to block transverse movement of the safety pin 3210 within the slide receptacle 3222. In the illustrative embodiment, the slide receptacle 3222 is sized and shaped complimentary to the first section 3216 of the safety pin 3210 to receive the safety pin 3210 for transverse movement therein but is too small to receive the second section 3218 therein. The latch receptacle 3224 is illustratively sized and shaped complimentary to the second section 3218 of the safety pin 3210 to receive the second section 3218 therein for reciprocating movement along the direction of an axis 27 as shown in FIG. 31. The release gates 3120 each includes a latch wall 3228 disposed between the latch receptacle 3224 and the slide receptacle 3222 defining an end of the latch receptacle 3224 against which the step 3220 abuts when the safety pin 3210 is received within the latch receptacle 3224.

The safety latch assembly 3200 illustratively includes a biasing member (illustratively embodied as a spring) positioned within the hole 3211 and biasing the safety pin 3210 into the latched position. When the safety pin 3210 is aligned with the latch receptacle 3224, the biasing-member 3230 biases the second section 3218 of the safety pin 3210 into the latched position within the latch receptacle 3224 to prevent translation of the safety pin 3210 within the pin slot 3212 and preventing removal of the lock pin 3106 from the respective locking hole 114 of the mounting bar 86. A user can depress the safety pins 3210 into their respective release gates 3120 to the unlatched position to remove the second section 3218 of the safety pin 3210 from the latch receptacle 3224 to allow translation of the safety pins 3210 along their respective pins slots 3212 and to release the locking pin 3104 for removal from the locking hole 114. The handle 3109 includes a cutout section 3232 having curvature complimentary to a user's hand to facilitate operation of the locking pin 3104. The safety latch assembly 3200 of the tilt assembly 3118 thus provides a safety mechanism requiring user operation (dual coordinated action) in order to disconnect the support bracket 3024 from the mounting bar 86.

In the illustrative embodiment as shown in FIG. 31, the tilt assembly 3118 allows selective pivoting of the support bracket 3024 while attached to the mounting bar 86 to assist connection of the catch assembly 3022 with the patient support top 14. The tilt assembly 3118 includes a pivot bolt 3135 pivotably connecting each bracket rail 3088 with its respective release gate 3120 and a pin 3136 for selectively preventing pivoting of the bracket rail about the pivot bolt 3135. Each pin 3136 is operable between a connection position (extended as indicated in broken line in FIG. 31) and a disconnection position similar (depressed as indicated in solid line in FIG. 31) to assist with connection and disconnection of the patient support top 14.

In the illustrative embodiment as shown in FIG. 31, the pin 3136 includes a first pin 3136*a* slidably disposed in a pin hole 3137*a* formed in the bracket rail 3088 and a second pin 3136*b* slidably disposed in a pin hole 3137*b* formed in the release gate 3120. The pins 3136*a*, 3136*b* and pin holes 3137*a*, 3137*b* are illustratively collinear (when the support bracket 3024 is in the connection position) and the pins 3136*a*, 3136*b* abut each other at their adjacent ends. When the pin 3136 is in the depressed position (as shown in solid line in FIG. 31) the pin 3136*b* is positioned wholly within the pin hole 3137*b* and not within the pin hole 3137*a* to release the tilt assembly 3118 to pivot the bracket rails 3088 about the pivot bolt 3135. When the pin 3136 is in the extended position (as shown in dotted line in FIG. 31) the pin 3136*b* is positioned partially within each of the pin holes 3137*a*, 3137*b* to prevent pivoting of the bracket rails 3088 about the pivot bolt 3135. A user can depress the 3136 to move the pin 3136 into the depressed position, and release the pin 3136 while the support bracket 3024 is in the connection position to allow the pin 3136 to be biased into the extended position.

As best shown in FIG. 30, the bracket rails 3088 and the respective handle 3109 define a gap 3244 therebetween to permit the bracket rails 3088 to pivot in the direction of arrows 3246 to assist connection with the patient support top 14. The support bracket 3024 can thus be pivoted away from the patient support top 14, similarly to support bracket 24, to facilitate connection with the patient support top 14.

Referring now to FIGS. 32-36, another illustrative embodiment is shown of support attachments 4016 adapted for use in the patient support device 10. The support attachments 4016 are similar to the support attachments 16, 1016, 2016, 3016 as disclosed herein. The description of the support attachments 16, 1016, 2016, 3016 apply to the support attachments 4016, except in instance of conflict with the specific disclosure of the support attachments 4016.

Figure 32:
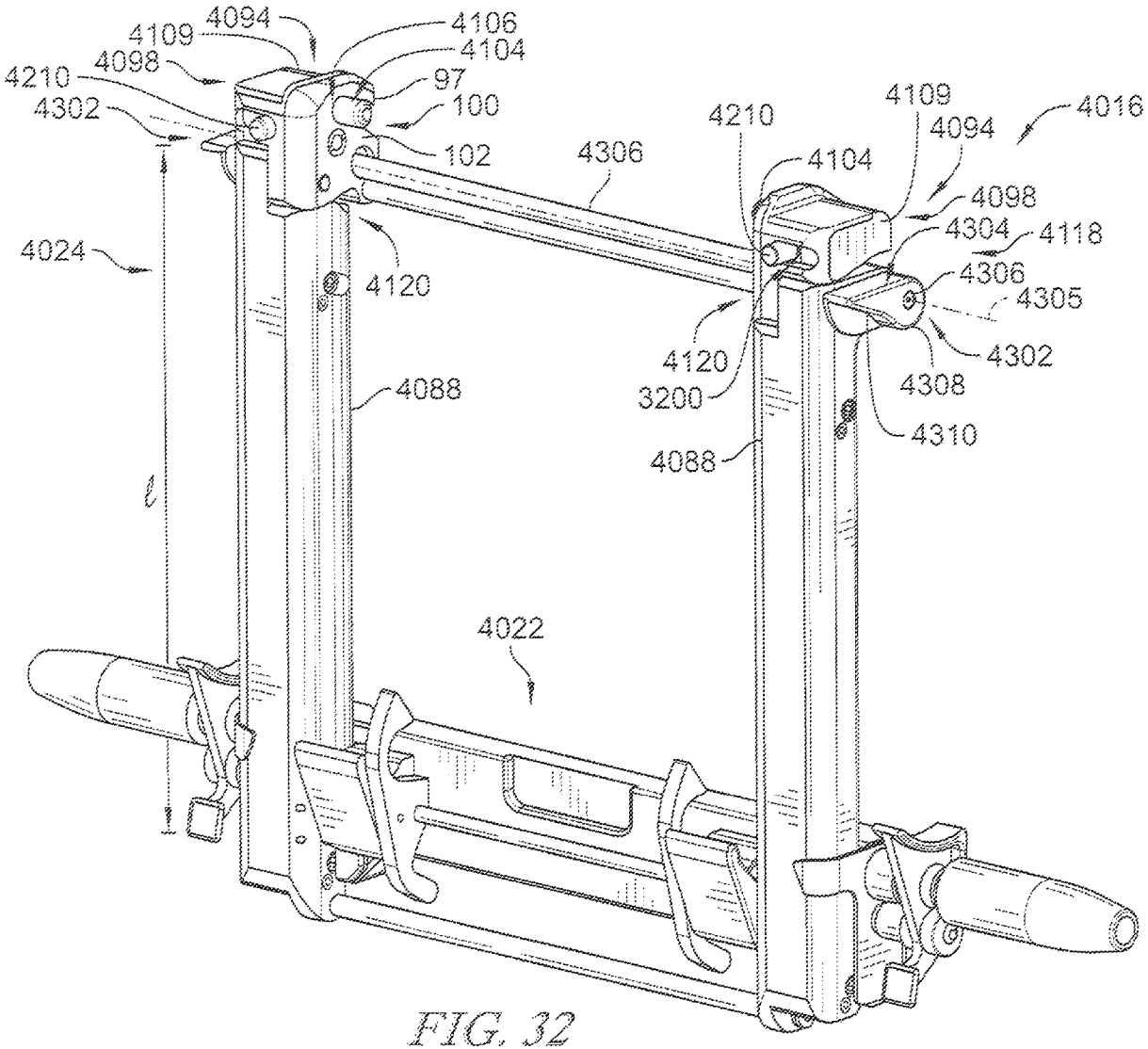
FIG. 32 is a perspective view of another embodiment of a support attachment adapted for use with the patient support showing that a tilt assembly includes a rotation lock assembly includes a handle for selectively locking and unlocking the support bracket for pivoting while remaining securely connected with the mounting bar.

As shown in FIG. 32, each support attachment 4016 is illustratively configured to selectively connect with the mounting bar 86 of one of the tower bases 12 and with the patient support top 14. Each support attachment 4016 illustratively includes a catch assembly 4022 slidably attached to a support bracket 4024 and selectively positionable along a length l of the support bracket 4024. The catch assembly 4022 of each support attachment 4016 is illustratively embodied as a top-loading catch assembly operable to selectively secure the patient support top 14 with the tower bases 12.

Each support bracket 4024 illustratively includes a pair of bracket rails 4088 spaced apart from each other and extending parallel to each other along the length l. In the illustrative embodiment as shown in FIG. 32, each bracket rail 4088 includes a tilt section 4094 having a lock pin assembly 4098 and a retainer slot 100 defined on an interior surface 102 thereof for attaching the support bracket 4024 to the mounting bar 86. Each retainer slot 100 is illustratively defined in the interior surface 102 for a length extending from a face 97 of the respective bracket rail 4088 at an angle relative to the extension length of the respective bracket rail 4088, the angle illustratively being less than 90 degrees to prevent undesired disengagement from the mounting bar 86.

As shown in FIG. 32, each lock pin assembly 4098 illustratively includes a locking pin 4104 connected to a handle 4109 for user operation. The locking pin 4104 is slidably received in a pin hole 4106 that extends through a release gate 4120 of the respective bracket rail 4088 and is aligned with the locking hole 114 of the mounting bar 86. A user can selectively operate each lock pin assembly 4098 by applying force to the respective handle 4109 to slide the locking pin 4104 between a retracted position (withdrawn from the locking hole 114) and an extended position (inserted within the locking hole 114 as shown in FIG. 32) to selectively secure the support bracket 4024 to the mounting bar 86. Each lock pin assembly 4098 illustratively includes a safety latch assembly, embodied to be similar to safety latch assembly 3200, for selectively preventing removal of the locking pin 4104 out from the locking hole 114 of the mounting bar 86. The safety latch assembly 3200 can reduce the risk of inadvertent disconnection of the support attachment 4016 from the mounting bar 86.

Figure 34:
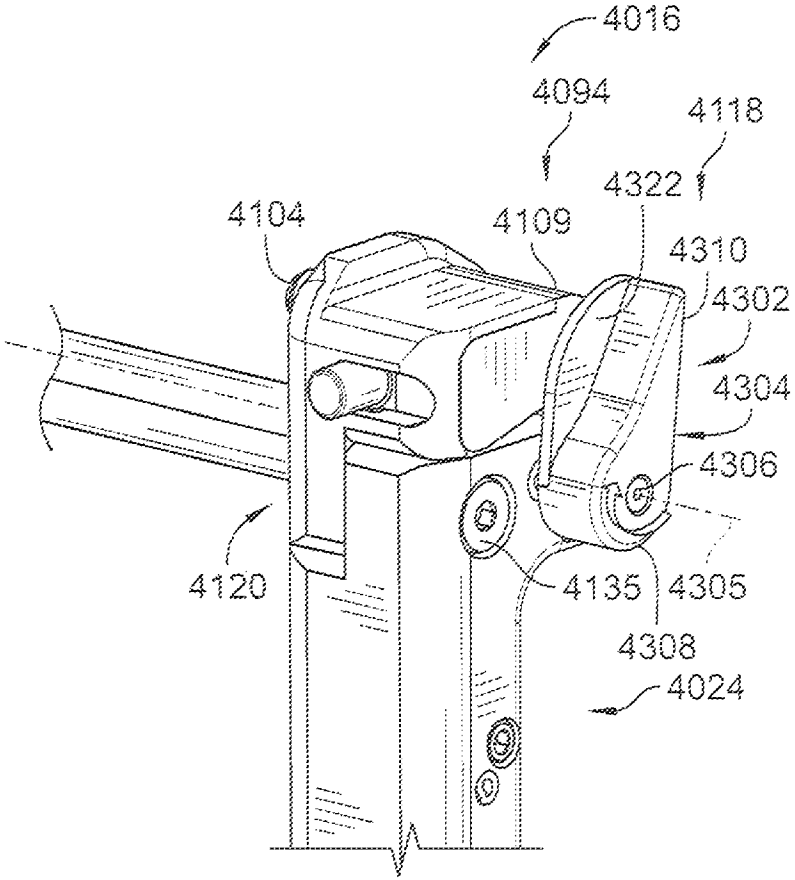
FIG. 34 is a perspective view of an enlarged portion of the support attachment of FIGS. 32 and 33 showing that the handle is positioned in the unlocked position.

As shown in FIG. 32, the support attachments 4016 illustratively include a tilt assembly 4118 for pivoting the support bracket 4024 while attached to the mounting bar 86 to assist connection of the catch assembly 4022 with the patient support top 14. The tilt assembly 4118 illustratively includes the pair of release gates 4120, one of each being pivotably connected to each bracket rail 4088 on a connection end thereof. The release gates 4120 illustratively provide the interior surface 102 of the respective bracket rail 4088 that defines the retainer slot 100 as described above regarding support brackets 24, 1024, 2024, 3024, 4024. As best shown in FIG. 34, the tilt assembly 4118 illustratively includes a pivot bolt 4135 that pivotably connects each bracket rail 4088 with its respective release gate 4120.

Figure 33:
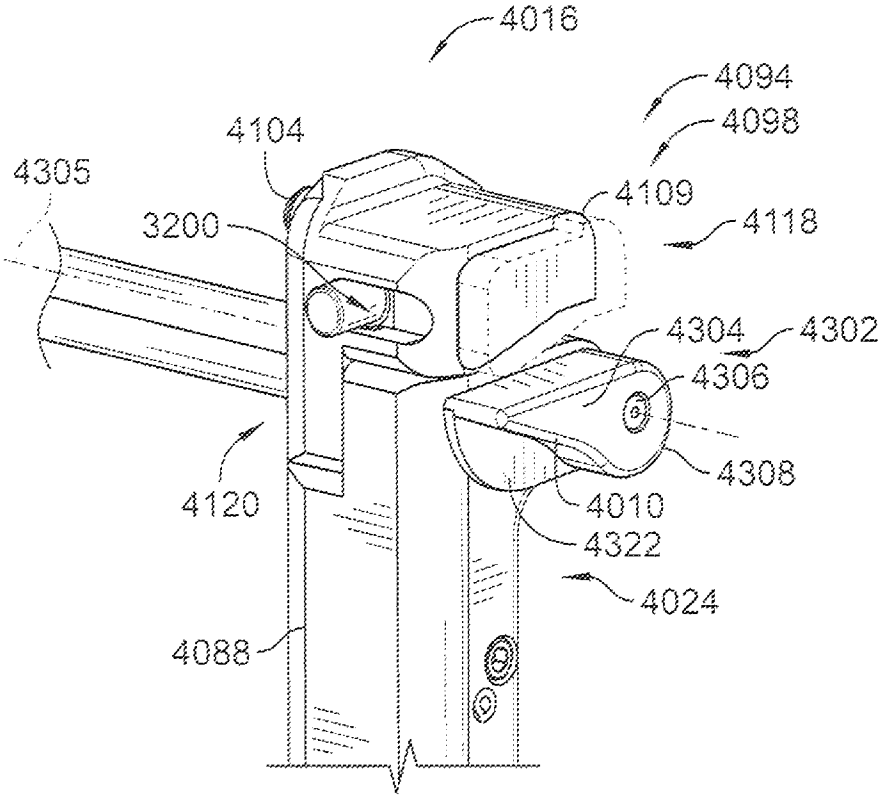
FIG. 33 is a perspective view of an enlarged portion of the support attachment of FIG. 32 showing that the handle is positioned in the locked position.

As described herein, with reference to FIGS. 33 and 34, the tilt assembly 4118 illustratively includes a rotation lock assembly 4302 for selectively allowing pivoting of the support bracket 4024. The rotation lock assembly 4302 is selectively operable to release pivoting of the support bracket 4024 (namely, the bracket rail 4088) about the pivot bolt 4135. The rotation lock assembly 4302 illustratively includes a lock handle 4304 and a shaft 4306 secured with the lock handle 4304 to receive rotation by a user's hand.

The lock handle 4304 is operable between a locked position (as suggested in FIG. 33) and an unlocked position (as suggested in FIG. 34), and the shaft 4306 is arranged in correspondence. A user can selectively operate the lock handle 4304 into the locked position to place the shaft 4306 in a corresponding locked position to prevent pivoting of the bracket rail 4088 about the pivot bolt 4135, and into the unlocked position to place the shaft 4306 in a corresponding unlocked position to allow pivoting of the bracket rail 4088 about the pivot bolt 4135. Accordingly, the rotation lock assembly 4302 can operate to selectively release the support bracket 4024 for pivoting while secured by the tilt section 4094 with the mounting bar 86 of the tower base 12.

The lock handle 4304 illustratively includes a base 4308 and a stem 4310 that extends from the base 4308. The stein 4310 illustratively extends from the base 4308 with ergonomic form for grasping by a user's hand to apply leverage to the base 4308. The shaft 4306 is illustratively connected with the base 4308 and projects along an axis 4305, orthogonally relative to the rotation plane and the stem 4310.

Figure 36:
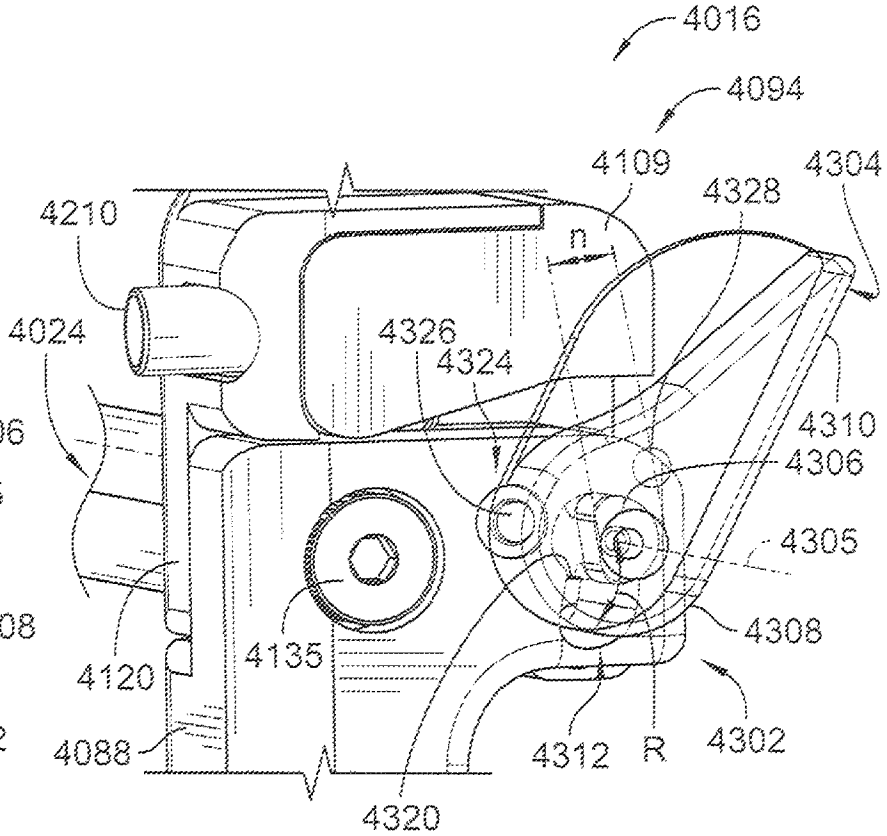
FIG. 36 is a perspective view of an enlarged portion of the support attachment of FIGS. 32-35 showing that the handle is positioned in the unlocked position and showing that the non-circular shaft has been rotated within the lockout slot to permit sliding (traversal) of the lockout slot relative to the shaft so that the support bracket may pivot when the handle is in the unlocked position.
Figure 35:
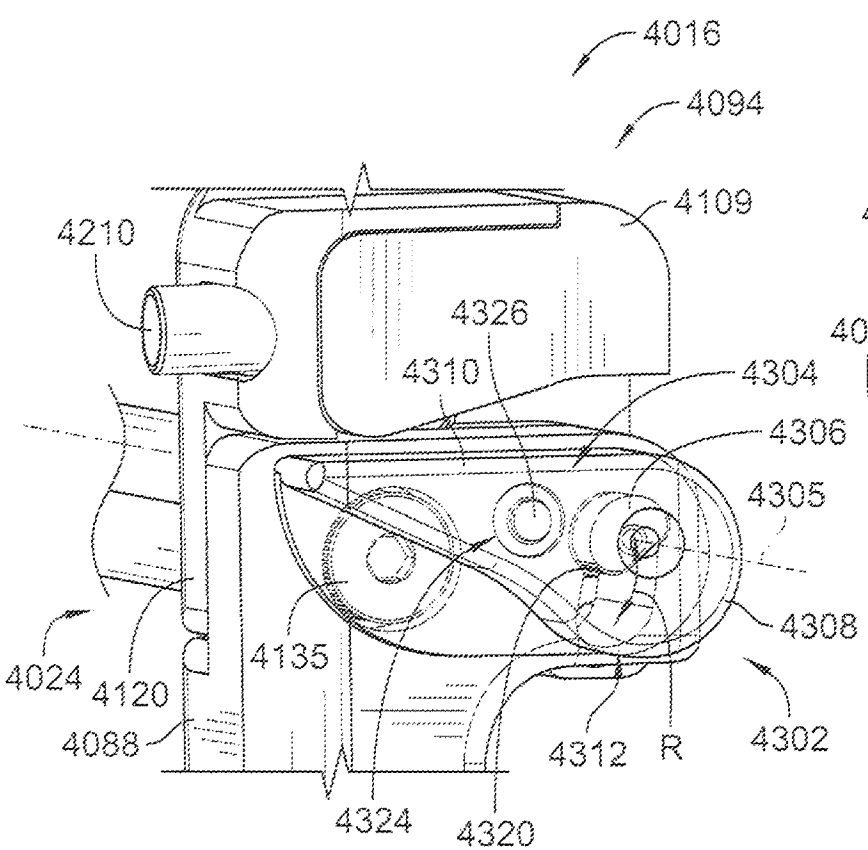
FIG. 35 is a perspective view of an enlarged portion of the support attachment of FIGS. 32-34 showing that the handle is positioned in the locked position and rendered transparent to show that a non-circular shaft is secured to the handle for rotation between corresponding locked and unlocked positions and that the shaft protrudes through a lockout slot of the support bracket which prevents pivoting of the support bracket when the handle is in the locked position.

As shown in FIGS. 35 and 36, the shaft 4306 illustratively extends along the axis 4305 from the lock handle 4304 and penetrates through a slot 4312 of the respective bracket rail 4088 and through the respective release gate 4120. The shaft 4306 illustratively extends from the respective release gate 4120 along the axis 4305 to the other release gate 4120, penetrates through the other release gate 4120 and through the slot 4312 in the respective (other) bracket rail 4088, and connects with the base 4308 of the other lock handle 4304 (as best suggested in FIG. 32). In the illustrative embodiment, the shaft 4306 is rotatingly supported in place by each of the release gates 4120 to selectively rotate about the axis 4305 under actuation by the lock handle 4304. The shaft 4306 illustratively remains in place relative to the bracket rails 4088 during pivoting of the bracket rails 4088 about the pivot bolts 4135 as the slots 4132 traverse along the shaft 4306 as discussed in additional detail below.

As shown in FIGS. 35 and 36, each slot 4132 illustratively defines curvature R formed complimentary to the pivoting motion of the support bracket 4024 about the pivot bolt 4135. When each lock handle 4304 is in the unlocked position, the support bracket 4024 can pivot (counter-clockwise in FIG. 36) by allowing each slot 4312 to accept the shaft 4306 to traverse along its curvature R relative. Description of traversal between the shaft 4306 and the slot 4312 refers to relative motion between the shaft 4306 and the slot 4312, and in the illustrative embodiment intends that while the shaft 4306 remains stationary, the support bracket 4024 is pivoted about the pivot bolt 4135 such that the slot 4312 moves along its curvature R relative to the shaft 4306. In some embodiments, the shaft 4306 may pivot along with the support bracket 4024 and the slot 4312 may remain stationary. When either of the lock handles 4304 are in the locked position, the shaft 4306 cannot traverse the respective slot 4312 as discussed in additional detail below.

Figure 38:
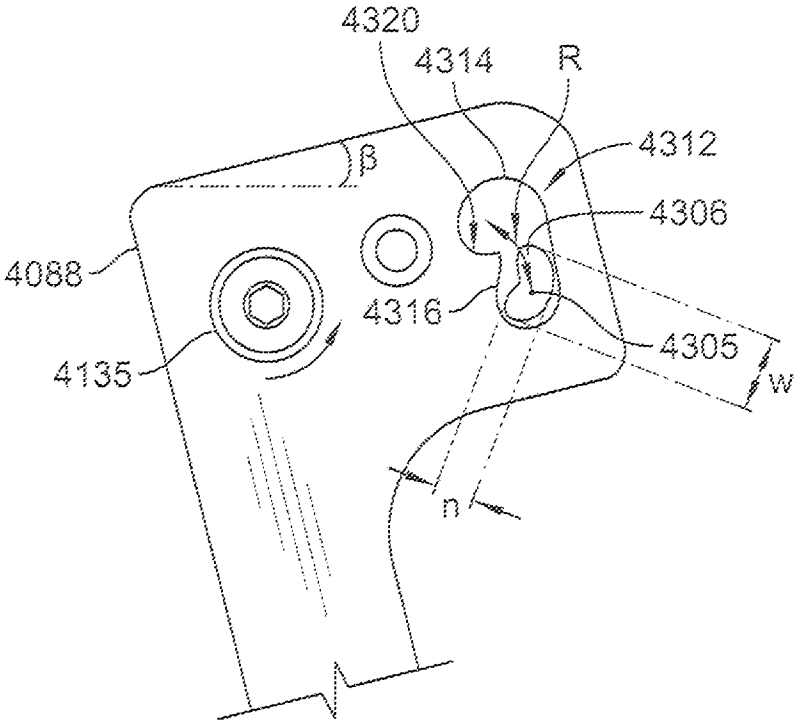
FIG. 38 is an elevation view of the enlarged portion of the support attachment of FIG. 37 showing that the shaft is in the unlocked position and the bracket rail has been pivoted (counter-clockwise) to traverse the pivot route portion around the shaft.
Figure 37:
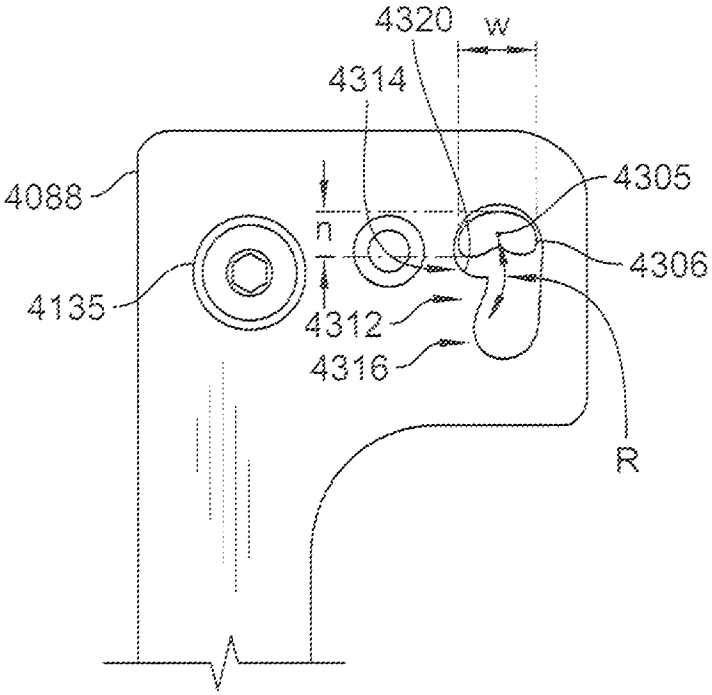
FIG. 37 is an elevation view of the enlarged portion of the support attachment of FIGS. 32-36 showing that the lockout slot includes a home portion to allow rotation of the non-circular shaft to the unlocked position and a pivot route portion which restricts acceptance of the shaft unless the shaft is arranged in the unlocked position.

In the illustrative embodiment as shown in FIGS. 37 and 38, the slot 4312 includes slot portions including a lock home 4314 and a pivot route 4316 extending from the lock home 4314 to define the curvature. The shaft 4306 illustratively has an asymmetrical shape in cross-section along the axis 4305, embodied as a bean shape. The lock home 4314 is formed to permit rotation of the shaft 4306 about axis 4305, between the locked and unlocked positions, when the shaft 4306 is seated therein (as suggested in FIGS. 35 and 36); and the pivot route 4316 is formed to allow traversal along the curvature R, but not rotation about axis 4305, of the shaft 4306, when the lock handle 4304 and the shaft 4306 are in the unlocked position.

In some embodiments, the shaft 4306 and slots 4312 may have any suitable shapes, sizing, and/or arrangement to restrict relative traversal of the shaft 4306 and the slot 4312, in certain angular positions of the shaft 4306 relative to the slot 4312, to prevent pivoting of the support bracket 4024 about the pivot bolt 4135; and to permit relative traversal of the shaft 4306 and the slot 4312, in certain other angular positions of the shaft 4306 relative to the slot 4312, to allow pivoting of the support bracket 4024 about the pivot bolt 4135. For example but without limitation, in some embodiments, the shaft 4306 may have a semi-circular cross-section and/or the lock home 4314 may be positioned intermediately along the curvature R of the pivot route 4316 to permit some degree of pivoting of the support bracket 4024 about the pivot bolt 4135 in either direction (clockwise and counter-clockwise) relative to the lock home 4314 position.

In the illustrative embodiment as shown in FIGS. 37 and 38, the cross-section of the shaft 4306 defines a width w and a breadth n, the width w being larger than the breadth n. The lock home 4314 portion of the slot 4312 is illustratively sized to have a diameter greater than or equal to the width w to permit rotation of the shaft 4306 when seated within the lock home 4314. The pivot route 4316 is illustratively sized and/or shaped complimentary to the breadth n of the shaft 4306 to permit translation when the shaft 4306 is in the unlocked position, but is sized and/or shaped uncomplimentary to the width w of the shaft 4306 to prevent entry and translation of the shaft 4306 into the pivot route 4316 when the shaft 4306 is in the locked position. For example but without limitation, in some embodiments, the pivot route may be sized smaller than the width w, but greater than or equal to the breadth n to permit entry and translation of the shaft 4306 into the pivot route 4316 only when the shaft 4306 is in the unlocked position.

When the shaft 4306 is seated in the lock home 4314 and positioned in the locked position, as shown in FIGS. 35 and 37, attempts to pivot the support bracket 4024 in the counter-clockwise direction are prevented by contact of the shaft 4306 with surfaces which define the slots 4312, namely, prohibitive contact with a transition edge portion 4320 formed between the lock home 4314 and the pivot route 4316. When the shaft 4306 is rotated into the unlocked position, as shown in FIGS. 36 and 38, the breadth n of the shaft 4306 is aligned with the pivot route 4316 such that pivoting the support bracket 4024 does not incur prohibitive contact between the transition edge portion 4320 and the shaft 4306 allowing entry and translation of the shaft 4306 relative to the slot 4312 along the curvature R of the pivot route 4316, and thus allowing pivoting of the supporting bracket 4024.

Returning briefly to FIGS. 33 and 34, the rotation lock assembly 4302 illustratively includes a wing 4322, for providing coordinated release prevention. The wing 4322 is formed as a sheet projecting from the lock handle 4304 (in the downward direction in the orientation of FIG. 33 and leftward in FIG. 34). The wing 4322 illustratively extends within the plane of rotation of the lock handle 4304 and provides an obstruction to operation of the tilt section 4094 to disconnect the support bracket 4024 from the mounting bar 86, at least upon unlocking of the tilt assembly 4118. Accordingly, in the illustrative embodiment, the wing 4322 is arranged to prevent disengagement of the tilt section 4094 while the tilt assembly 4118 is unlocked.

As shown in FIG. 34, when the lock handle 4304 is arranged in the unlocked position to permit pivoting of the support bracket 4024 about the pivot bolt 4135, the wing 4322 is illustratively arranged to block the handle 4109 of the tilt section 4094 from being placed into the retracted position (to the right in the orientation of FIG. 34, away from the bracket rail 4088). Thus, even under operation of the safety latch assembly 3200 to permit retraction the locking pin 4104 from engagement with the mounting bar 86, the wing 4322 obstructs this operation when the lock handle 4304 is in the unlocked position. As shown in FIG. 33, when the lock handle 4304 is in the locked position, the wing 4322 is clear of the movement of the handle 4109 into the retracted position (as shown in dashed line) to withdraw the locking pin 4104 from engagement with the mounting bar 86.

Likewise, as suggested in FIG. 33, upon operation of the handle 4109 to retract the locking pin 4104 from the mounting bar 86 (as shown in dashed line), the handle 4109 extends into plane of rotation of the lock handle 4304 preventing rotation of the lock handle 4304 into the unlocked position. Accordingly, the present embodiment can include arrangement to prevent unlocking of the tilt assembly 4118 while the tilt section 4094 is disengaged (locking pin 4104 in the retracted position).

Returning to FIGS. 35 and 36, the rotation lock assembly 4302 illustratively includes a feedback system 4324 for communicating whether the lock handle 4304 is in the locked position. The feedback system 4324 illustratively includes a ball detent 4326 that is mounted into the bracket rail 4088 with spring-loading to resiliently protrude from the bracket rail 4088 for engagement with the lock handle 4304. As best seen in FIG. 36, the lock handle 4304 illustratively includes a receiver 4328 formed concave and complimentary to the ball detent 4326, and arranged to receive the ball detent 4326 when the lock handle 4304 is in the locked position (as suggested in FIG. 35).

In the illustrative embodiment the ball detent 4326 and the receiver 4328 are complimentary spherical to permit ramped sliding therebetween. When the ball detent 4326 is received within the receiver 4328, the spring-loading applies a force that must be overcome in order to depress the ball detent 4326 into the bracket rail 4088 to allow rotation of the lock handle 4304. Upon rotation of the lock handle 4304, a wedge action occurs between the receiver 4328 and the ball detent 4326 to depress the ball detent 4326 against the spring-loading and into the bracket rail 4088 to permit rotation of the lock handle 4304 towards the unlocked position. The release of the ball detent 4326 out of the receiver 4328 is communicated to the user; namely, the release can be felt by the operator's hand as a sudden relief of rotational resistance of the lock handle 4304. Similarly, rotation of the lock handle 4304 into the locked position causes alignment between the depressed ball detent 4326 such that the ball detent 4326 extends under spring-loading into the receiver 4328. The seating of ball detent 4326 into the receiver 4328 is communicated to the user as a feeling of sudden resistance to rotation of the lock handle 4304. Seating of the ball detent 4326 can provide slight resistance to unintentional rotation of the lock handle 4304 out of the locked position. In some embodiments, the ball detent 4326 and receiver 4328 may have any suitable complimentary shapes. The feedback system 4324 can provide communication of seating and unseating of the lock handle 4304 in the locked position and/or discourage unintentional movement of the lock handle 4304 out of the locked position.

The present disclosure includes interaction between complimentary and/or uncomplimentary features. In some embodiments, complimentary and/or uncomplimentary features can be reversed in position, have alternative and/or uncomplimentary shapes, respectively, and/or other arrangements forming suitable complimentary and/or uncomplimentary relationships, as appropriate. In some embodiments, the angle β of pivoting of the support bracket to facilitate receiving the attachment of the connector 20 with the catch assembly may be in the range of about 1 to about 35 degrees, and in some embodiments, about 15 degrees.

Although certain illustrative embodiments have been described in detail above, variations and modifications exist within the scope and spirit of this disclosure as described and as defined in the following claims.

We claim:

1. A patient support device comprising:

a patient support top including a connector disposed at an end thereof, an end support configured to support the patient support top, and a support attachment connected with the end support and including a catch assembly configured for selective connection with the connector of the patient support top, the catch assembly including a receptacle for receiving the connector and a latch assembly for selectively blocking removal of the connector from the receptacle, the receptacle including an entry opening for acceptance of the connector of the patient support top into the receptacle, wherein the support attachment includes a bracket and the catch assembly is connected with the bracket, the bracket including a tilt assembly for selective pivoting of the catch assembly while secured with the end support to assist selective connection with the patient support top, the tilt assembly including a release gate secured with the end support and attached to a rail of the bracket for selective pivoting of the catch assembly, and a tilt lock assembly operable between an unlatched state to allow pivoting of the rail relative to the release gate and a latched position to block pivoting of the rail relative to the release gate.

2. The patient support device of claim 1, wherein the latch assembly includes a latch operable between a first position in which the latch is clear from the entry opening to allow acceptance of the connector within the receptacle and a second position in which the latch extends at least partly across the entry opening to block removal of the connector from the receptacle.

3. The patient support device of claim 1, wherein the tilt lock assembly includes a lock shaft rotatably mounted in one of the rail and the release gate and operable between a locked position to engage both the rail and the release gate to block relative pivoting and an unlocked position to at least partly disengage with the other of the rail and the release gate to allow relative pivoting.

4. The patient support device of claim 3, wherein the tilt lock assembly includes a lock slot defined within the other of the rail and the release gate, the lock slot including a lock home and a pivot route extending for a length from the lock home.

5. The patient support device of claim 4, wherein the length of the pivot route has a curvature corresponding with pivoting of the rail relative to the release gate.

6. The patient support device of claim 4, wherein the lock shaft extends into the lock slot, the lock shaft and the lock slot formed in correspondence with each other to permit relative traversal of the lock shaft within the pivot route only in the unlocked position.

7. The patient support device of claim 6, wherein the lock shaft has a non-circular cross-section.

8. The patient support device of claim 4, wherein the lock shaft extends into the lock slot, the lock shaft and the lock slot formed in correspondence with each other to prevent relative entry of the lock shaft into the pivot route in the locked position.

9. The patient support device of claim 4, wherein the lock shaft extends into the lock slot, the lock shaft and the lock slot formed in correspondence with each other to permit selective rotation of the lock shaft only when arranged within the lock home.

10. A support attachment of a patient support device for attachment between an end support and a connector of a patient support top of the patient support device, the support attachment comprising:

a bracket adapted to connect with the end support, a catch assembly attached with the bracket, the catch assembly including a receptacle for receiving the connector of the patient support top and a latch assembly for selectively blocking removal of the connector from the receptacle, and a tilt assembly including a release gate pivotably connected with the bracket and including a tilt lock assembly operable between an unlocked state to allow pivoting of the bracket relative to the release gate and a locked state to block pivoting of the bracket relative to the release gate.

11. The support attachment of claim 10, wherein the catch assembly includes a pawl assembly having a pawl adapted to selectively fix the catch assembly relative to the bracket, the pawl being operable between a locked position and an unlocked position, wherein the pawl includes a lever having a pawl end and a pawl head that extends from the pawl end for engagement with the bracket.

12. The support attachment of claim 11, wherein the bracket includes a pawl track having a number of teeth consecutively arranged for engagement with the pawl head to selectively fix the catch assembly relative to the bracket.

13. The support attachment of claim 12, wherein adjacent teeth of the number of teeth cooperate to define a pawl space for receiving the pawl head therein to selectively fix the catch assembly in position, wherein the pawl head is selectively received within the pawl space, and the pawl head is blocked against removal from the pawl space by at least one of the adjacent teeth without unloading of the catching assembly.

14. The support attachment of claim 13, wherein the lever is pivotable to place the pawl between the locked and unlocked positions, and pivoting movement of the lever of the pawl corresponds with the pawl space, as defined by the adjacent teeth, to require that the pawl head be located intermediately within the pawl space arranging the pivoting movement of the lever to be free of contact between the pawl head and either of the adjacent teeth to allow the pawl to be operated into the unlocked position.

15. The support attachment of claim 14, wherein the pawl head is positioned intermediately within the pawl space by translation of the catch assembly along the bracket with the pawl in the locked position.

16. The support attachment of claim 10, wherein the tilt assembly includes a tilt lock assembly including a lockout member positionable between a locked position and an unlocked position to achieve the locked and unlocked states, respectively.

17. The support attachment of claim 16, wherein the lockout member of the tilt lock assembly includes a lock shaft rotatably arranged in at least one of the rail and the release gate and operable between a locked position to engage both the rail and the release gate to block relative pivoting and an unlocked position to allow relative pivoting.

18. The support attachment of claim 17, wherein the tilt lock assembly includes a lock slot defined within the other of the release gate and the rail, the lock slot including a lock home and a pivot route extending for a length from the lock home, wherein the lock shaft extends into the lock slot, the lock shaft and the lock slot formed in correspondence with each other to permit relative traversal of the lock shaft within the pivot route only in the unlocked position.

* * * * *